US006779873B2

(12) United States Patent
Maeda et al.

(10) Patent No.: US 6,779,873 B2
(45) Date of Patent: Aug. 24, 2004

(54) INK JET PRINTING APPARATUS AND METHOD

(75) Inventors: Tetsuhiro Maeda, Kawasaki (JP); Hiroshi Tajika, Kanagawa (JP); Miyuki Fujita, Tokyo (JP); Yuji Konno, Kanagawa (JP); Norihiro Kawatoko, Kanagawa (JP); Takayuki Ogasahara, New York, NY (US); Tetsuya Edamura, Kanagawa (JP); Atsuhiko Masuyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 94 days.

(21) Appl. No.: 10/108,459

(22) Filed: Mar. 29, 2002

(65) Prior Publication Data

US 2002/0167565 A1 Nov. 14, 2002

(30) Foreign Application Priority Data

Apr. 2, 2001 (JP) ..... 2001-103770

(51) Int. Cl.[7] ..... B41J 2/25
(52) U.S. Cl. ..... 347/43; 347/41
(58) Field of Search ..... 347/43, 15, 41, 347/37, 16, 40, 12

(56) References Cited

U.S. PATENT DOCUMENTS 5,696,542 A 12/1997 Matsubara et al. ..... 347/12
6,106,093 A 8/2000 Nagoshi et al. ..... 347/15
6,164,745 A 12/2000 Nagoshi et al. ..... 347/15
6,193,358 B1 2/2001 Fujita et al. ..... 347/41
6,206,502 B1 * 3/2001 Kato et al. ..... 347/41

FOREIGN PATENT DOCUMENTS

JP 6-336016 12/1994
JP 2000-37863 2/2000

* cited by examiner

*Primary Examiner*—Lamson D Nguyen
(74) *Attorney, Agent, or Firm*—Fitzpatrick, Cella, Harper & Scinto

(57) ABSTRACT

The present invention provides a method of printing a high quality color image with no color variations at high speed. For this purpose, this invention arranges in a main scan direction a plurality of print heads that eject different color inks, and reciprocally moves each of the print heads to perform a multipass printing in which a print operation is executed in both the forward and backward passes. During the multipass printing, the print duties of the print heads are set by mask patterns. Each of the mask patterns divides the print duty setting area for each nozzle group of each head into subdivided areas, sets the print duties of the subdivided areas to values different from each other and sets the print duties of the print heads to different values.

19 Claims, 32 Drawing Sheets

MASK PATTERN (PC)

◎→ CONSPICUOUSLY NOTICEABLE
○→ SLIGHTLY NOTICEABLE
△→ RATHER UNNOTICEABLE

RESULT OF EVALUATION ON COLOR VARIATIONS OF SECONDARY COLOR

| | Bk | PC | PM | C | M | Y |
|---|---|---|---|---|---|---|
| Bk | — | ◎ | ◎ | ○ | ○ | ◎ |
| PC | | – | ◎ | △ | ◎ | ○ |
| PM | | | – | ◎ | △ | ○ |
| C | | | | – | ◎ | ◎ |
| M | | | | | – | ◎ |
| Y | | | | | | – |

FIG.25

INK JET PRINTING APPARATUS AND METHOD

This application is based on Patent Application No. 2001-103770 filed Apr. 2, 2001 in Japan, the content of which is incorporated hereinto by reference.

BACKGROUND OF THE INVENTION

1. Field of the Invention

The present invention relates to an ink jet printing apparatus which ejects ink from a print head to form an image. In particular, the present invention relates to an ink jet printing apparatus which has four or more color ink print heads arranged in a main scan direction and performs printing in both forward and backward scans. More specifically the present invention relates to a method of reducing color variations caused by changes in the ejection order of color inks.

2. Description of the Related Art

Printing apparatus generally applied to printers, copying machines and facsimiles print an image of dot pattern on a print medium, such as paper and a thin plastic sheet, according to image information.

Such printing apparatus can be classified into, for example, an ink jet printing system, a wire dot printing system, a thermal printing system and a laser beam printing system. An ink jet printing apparatus that uses the ink jet printing system projects ink droplets from nozzles of print heads onto a print medium to form an image on it.

As a variety of kinds of printing apparatus has come to be used in recent years, there are growing demands on these printing apparatus for higher printing speed, higher resolution, higher image quality and reduced noise. An example printing apparatus that can optimumly meet such requirements is the ink jet printing apparatus described above. Since the ink jet printing apparatus ejects ink from the print heads, the ink ejection operation and the amount of ink ejected need to be stabilized to meet the above requirements.

In realizing a further increase in the printing speed of the ink jet printing apparatus, it is considered essential to perform a forward-backward printing (or bi-directional printing) in which the printing is done in both the forward pass and the backward pass of the main scan of the print heads. When a color image is to be formed using the forward-backward printing, a problem arises that color variations are caused by changes in the printing order of inks.

A mechanism by which two color inks penetrate into a print medium will be explained by referring to FIG. 12. In print mediums (OHP and film-based medium) which absorb ink slowly, the dye/pigment particles of two color inks are mixed together as they soak into the medium, so that a hue difference caused by a change in the printing order of the color inks is relatively small. However, in print mediums (dedicated paper, glossy paper, etc.) that absorb ink quickly, since the dye/pigment particles of two inks penetrate and fix in the medium separately, the hue difference due to the change in the printing order is conspicuous.

In one embodiment of the present invention using six color heads arranged laterally side by side as shown in FIG. 14, color variations considered to be produced by a difference in the printing order between the forward pass and the backward pass are observed. When a G (green) image (not shown) is formed by printing in both the forward and backward passes, for example, the order of printing differs between the forward pass and the backward pass. That is, the C (cyan) is printed first followed by Y (yellow) in the forward pass thus producing a G image with a strong hue of cyan. In the backward pass, Y (yellow) is printed first followed by C (cyan) thus producing a G image with a strong hue of yellow. This alternate hue variation is recognized as bands at a pitch corresponding to the feeding distance of the print medium.

FIG. 11 shows an example of a multipass printing method that completes printing one print area with four print scans. A print head with 16 nozzles is divided into four equal nozzle groups, each of which prints through a thinning out mask pattern shown at the left end of the figure in all scans. The thinning out mask pattern can be set in the form of a fixed mask pattern or a random mask pattern. Pixels painted black represent those printed at each current print scan and pixels painted gray represent those already printed at or before the preceding scans. When printing is done with 25% thinning out, the image is formed with four print scans. How an image is formed using such a mask pattern is shown in FIG. 13.

Suppose a carriage M1002 is reciprocated to perform the bi-directional printing. When a plurality of heads ejecting different color inks are arranged side by side in the main scan direction as shown in FIG. 13, a color variation is observed which is considered to be produced by a difference in the printing order of the heads between the forward pass and the backward pass. This color variation appears in the form of bands at a pitch corresponding to the feeding distance of the print medium. In FIG. 14, HY represents a print head for ejecting a yellow ink; HM represents a print head for ejecting a magenta ink; HC represents a print head for ejecting a cyan ink; HML represents a print head for ejecting a light magenta ink; HCL represents a print head for ejecting a light cyan ink; and HK represents a print head for ejecting a black ink.

FIG. 11 shows a mechanism by which a color variation observed during a multipass printing is produced. In this example, four passes are performed to print one print area and the mask patterns used in the four scans are complementary to each other. When an image of a uniform secondary color of G (green) is to be formed by four print scans, as shown in the figure, the color print image are printed in the order from C to Y or from Y to C. In this case, the C ink which is printed first is adsorbed on the surface of the print media and the Y ink which is subsequently printed penetrates into the print medium in the direction of its depth. This phenomenon is considered due to the fact that because the surface portion of the print area to which the dye can attach is deprived by the first printed ink, the subsequently printed ink penetrates into the medium in the direction of its depth. Hence, the hue obtained with the C ink printed first and the hue obtained with the Y ink printed first differ, and this hue difference caused by the difference in the printing order of the two inks visibly appears as color variations, which degrade an image quality.

One example of a printed area formed by printing under the conditions of FIG. 11 is shown in FIG. 13. It is seen from the figure that there are density variations in the form of stripes or bands at a pitch corresponding to the paper feed distance.

As a measure to reduce the color variations, Japanese Patent Application Laid-open No. 6-336016 (1994), for example, discloses a technique of using an ejection mask pattern which comprises concentrated dot patterns elongate in the main scan direction as basic units. This technique has been verified to be effective for use with ink jet heads with a dot resolution of 300 dpi–600 dpi.

Further, Japanese Patent Application Laid-open No. 2000-37863 discloses a technique applied to ink jet print heads with a higher resolution of, for example, 720 dpi to 1200 dpi, in which each of the concentrated dot units is made relatively large, for example, 8 dots long and 16 dots wide. With this technique, even when an overlapping of dots occurs at a boundary between regions of different colors, it is possible to reduce color variations at an overlapping boundary portion caused by a change in the scan direction of the print heads.

However, as ink jet printers with higher resolutions of 720 dpi to 1200 dpi become available as a result of technological advance, the diameters of dots formed in Japanese Patent Application Laid-open No. 6-336016 (1994) also decreases further down to about 40 $\mu$m to 50 $\mu$m Even when the nozzle arrangement density increases, decreasing the amount of ink ejected from each nozzle and therefore the dot diameter, the landing error of ejected ink droplet does not change as much and thus becomes large relative to the dot diameter. As a result, it is becoming increasingly difficult to realize an intended high-resolution dot pattern on a print medium. Hence, in the forward-backward pass printing (bi-directional printing), simply applying the conventional design method of an ink ejection mask pattern to the high-resolution printing cannot effectively reduce the color variations and image disturbances that are likely to occur during the bi-directional printing.

Also in Japanese Patent Application Laid-open No. 2000-37863, since the unit size of the concentrated pixel group that produces a satisfactory effect of reducing the color variations is large in the high resolution printing method of recent years, a problem is observed in which a cyclic texture is easily visible on a printed image. Although this problem can be dealt with in an image forming that places an importance on sharp outlines, such as DTP and graphics, it is not possible to ensure a satisfactory quality with photographic images.

SUMMARY OF THE INVENTION

It is an object of the present invention to provide an ink jet printing apparatus in which a plurality of print heads are arranged in the main scan direction and which can reduce color variations and texture caused by a difference in the printing order between the forward pass and the backward pass.

To achieve this objective, the present invention provides an ink jet printing apparatus comprising: a plurality of print heads arranged in a main scan direction and having different inks, each of the print heads having a plurality of nozzle groups, each nozzle group having a plurality of ink ejection nozzles, the different nozzle groups in each of the print heads being scanned over the same print area on a print medium in forward and backward passes to complete an image on the print area by using a plurality of inks; and a print duty setting means for dividing a print duty setting area for each of the nozzle groups into a plurality of subdivided areas, for setting a print duty for each of the subdivided areas and for setting print duties of the print heads to different values.

In another aspect, the present invention provides an ink jet printing apparatus comprising: a plurality of print heads arranged in a main scan direction and having different inks, each of the print heads having a plurality of nozzle groups, each nozzle group having a plurality of ink ejection nozzles, the different nozzle groups in each of the print heads being scanned over the same print area on a print medium in forward and backward passes to complete an image on the print area by using a plurality of inks; and a print duty setting means for setting print duties of end portions of each of the print heads lower than print duties of other portions.

In still another aspect, the present invention provides an ink jet printing apparatus comprising: a plurality of print heads arranged in a main scan direction and having different inks, each of the print heads having a plurality of nozzle groups, each nozzle group having a plurality of ink ejection nozzles, the different nozzle groups in each of the print heads being scanned over the same print area on a print medium in forward and backward passes to complete an image on the print area by using a plurality of inks; and a print duty setting and modification means for switching a print duty distribution in a nozzle array direction between high and low values according to a frequency of use of the print head.

In further aspect, the present invention provides an ink jet printing method for an ink jet printing apparatus, wherein the ink jet printing apparatus includes a plurality of print heads arranged in a main scan direction and having different inks, each of the print heads having a plurality of nozzle groups, each nozzle group having a plurality of ink ejection nozzles, the ink jet printing method comprising the steps of: scanning the different nozzle groups in each of the print heads over the same print area on a print medium in forward and backward passes to complete an image on the print area by using a plurality of inks; dividing a print duty setting area for each of the nozzle groups into a plurality of subdivided areas; setting a print duty for each of the subdivided areas; and setting print duties of the print heads to different values.

In a further aspect, the present invention provides an ink jet printing method for an ink jet printing apparatus, wherein the ink jet printing apparatus includes a plurality of print heads arranged in a main scan direction and having different inks, each of the print heads having a plurality of nozzle groups, each nozzle group having a plurality of ink ejection nozzles, the ink jet printing method comprising the steps of: scanning the different nozzle groups in each of the print heads over the same print area on a print medium in forward and backward passes to complete an image on the print area by using a plurality of inks; and setting print duties of end portions of each of the print heads lower than print duties of other portions.

In further aspect, an ink jet printing method for an ink jet printing apparatus, wherein the ink jet printing apparatus includes a plurality of print heads arranged in a main scan direction and having different inks, each of the print heads having a plurality of nozzle groups, each nozzle group having a plurality of ink ejection nozzles, the ink jet printing method comprising the steps of: scanning the different nozzle groups in each of the print heads over the same print area on a print medium in forward and backward passes to complete an image on the print area by using a plurality of inks; and switching a print duty distribution in a nozzle array direction between high and low values according to a frequency of use of the print head.

As described above, since the print duties of the print heads arranged in the main scan direction are set to different values, the color variations caused by a difference in the printing order between the forward pass and the backward pass can be minimized and a high quality color image printed at high speed. Further, by switching the print duties for each print head between high and low values according to the state of use of the nozzles, it is possible to prevent partial degradation of the print head and thereby improve its service life.

Further, since the print duty setting area for each nozzle of each print head is divided into a plurality of subdivided areas and the print duties of the subdivided areas are set to different values, an image printed can be prevented from developing a texture and thus ensure a high image quality.

Further, since the print duties of nozzle groups situated at both ends of the print head are set low, it is possible to reduce the formation of blank lines caused by deviations of ink dots ejected from end portions of the print head as it moves during the printing operation. Therefore, a substantial improvement of image quality can be expected.

The above and other objects, effects, features and advantages of the present invention will become more apparent from the following description of embodiments thereof taken in conjunction with the accompanying drawings.

BRIEF DESCRIPTION OF THE DRAWINGS

FIG. 25 is a table showing a result of evaluation of color variation produced when two colors are combined to form a solid image of a secondary color;

DETAILED DESCRIPTION OF PREFERRED EMBODIMENTS

Embodiments of the printing apparatus according to the present invention will be described by referring to the accompanying drawings.

In the following description we take up as an example a printing apparatus using an ink jet printing system.

In this specification, a word "print" (or "record") refers to not only forming significant information, such as characters and figures, but also forming images, designs or patterns on printing medium and processing media, whether the information is significant or insignificant or whether it is visible so as to be perceived by humans.

The word "print medium" or "print sheet" include not only paper used in common printing apparatus, but cloth, plastic films, metal plates, glass, ceramics, wood, leather or any other material that can receive ink. This word will be also referred to "paper".

Further, the word "ink" (or "liquid") should be interpreted in its wide sense as with the word "print" and refers to liquid that is applied to the printing medium to form images, designs or patterns, process the printing medium or process ink (for example, coagulate or make insoluble a colorant in the ink applied to the printing medium).

1. Apparatus Body

Figure 1:
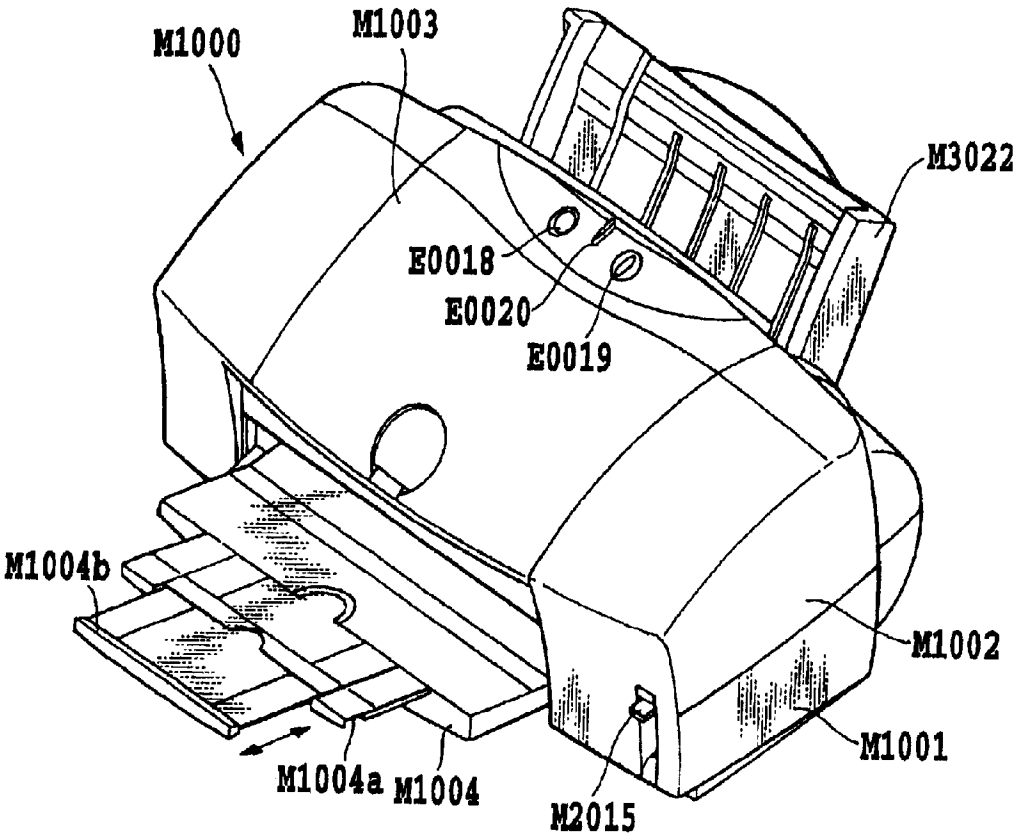
FIG. 1 is a perspective view showing an external construction of an ink jet printer as one embodiment of the present invention.
Figure 2:
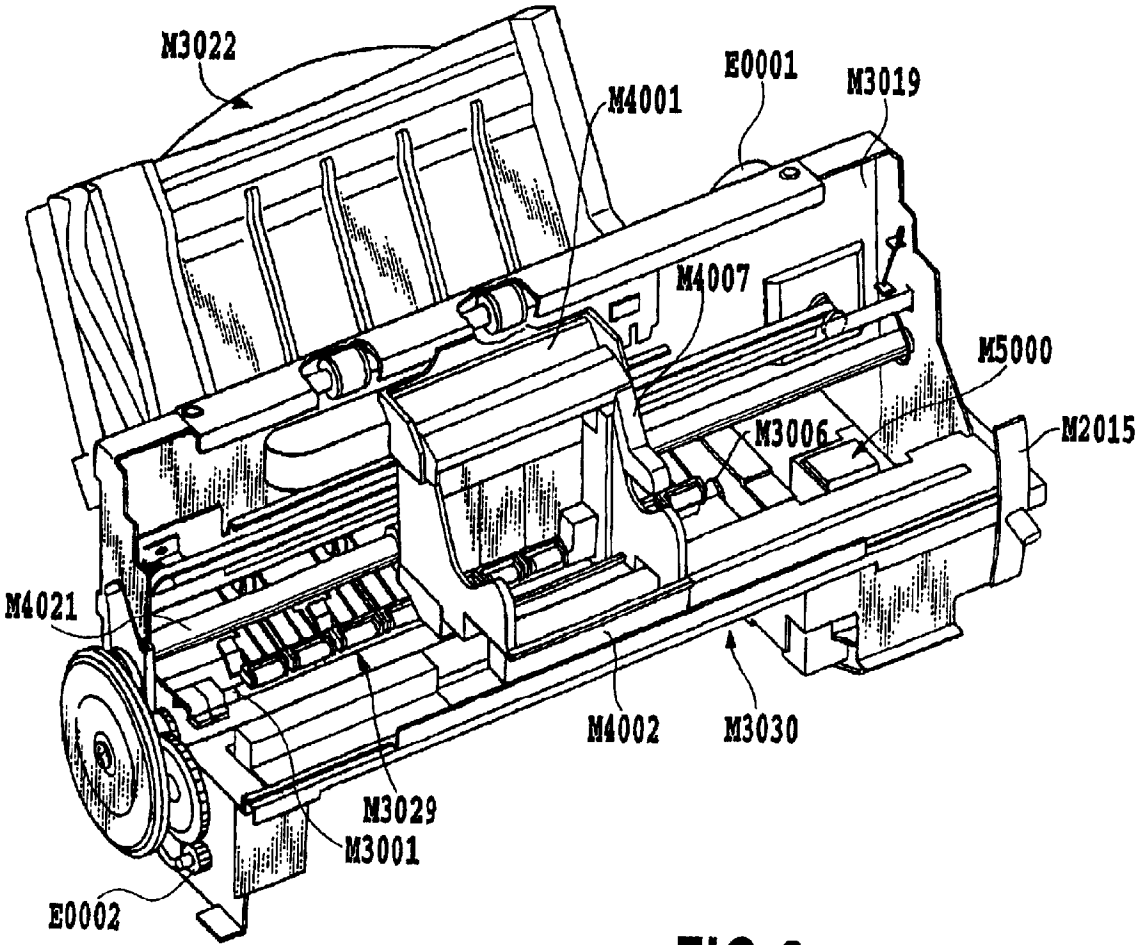
FIG. 2 is a perspective view showing the printer of FIG. 1 with an enclosure member removed.

FIGS. 1 and 2 show an outline construction of a printer using an ink jet printing system. In FIG. 1, a housing of a printer body M1000 of this embodiment has an enclosure member, including a lower case M1001, an upper case M1002, an access cover M1003 and a discharge tray M1004, and a chassis M3019 (see FIG. 2) accommodated in the enclosure member.

The chassis M3019 is made of a plurality of plate-like metal members with a predetermined rigidity to form a skeleton of the printing apparatus and holds various printing operation mechanisms described later.

The lower case M1001 forms roughly a lower half of the housing of the printer body M1000 and the upper case M1002 forms roughly an upper half of the printer body M1000. These upper and lower cases, when combined, form a hollow structure having an accommodation space therein to accommodate various mechanisms described later. The printer body M1000 has an opening in its top portion and front portion.

The discharge tray M1004 has one end portion thereof rotatably supported on the lower case M1001. The discharge tray M1004, when rotated, opens or closes an opening formed in the front portion of the lower case M1001. When the print operation is to be performed, the discharge tray M1004 is rotated forwardly to open the opening so that printed sheets can be discharged and successively stacked. The discharge tray M1004 accommodates two auxiliary trays M1004*a*, M1004*b*. These auxiliary trays can be drawn out forwardly as required to expand or reduce the paper support area in three steps.

The access cover M1003 has one end portion thereof rotatably supported on the upper case M1002 and opens or closes an opening formed in the upper surface of the upper case M1002. By opening the access cover M1003, a print head cartridge H1000 or an ink tank H1900 installed in the body can be replaced. When the access cover M1003 is opened or closed, a projection formed at the back of the access cover, not shown here, pivots a cover open/close lever. Detecting the pivotal position of the lever as by a micro-switch and so on can determine whether the access cover is open or closed.

At the upper rear surface of the upper case M1002 a power key E0018, a resume key E0019 and an LED E0020 are provided. When the power key E0018 is pressed, the LED E0020 lights up indicating to an operator that the apparatus is ready to print. The LED E0020 has a variety of display functions, such as alerting the operator to printer troubles as by changing its blinking intervals and color. Further, a buzzer E0021 (FIG. 7) may be sounded. When the trouble is eliminated, the resume key E0019 is pressed to resume the printing.

2. Printing Operation Mechanism

Next, a printing operation mechanism installed and held in the printer body M1000 according to this embodiment will be explained.

The printing operation mechanism in this embodiment comprises: an automatic sheet feed unit M3022 to automatically feed a print sheet into the printer body; a sheet transport unit M3029 to guide the print sheets, fed one at a time from the automatic sheet feed unit, to a predetermined print position and to guide the print sheet from the print position to a discharge unit M3030; a print unit to perform a desired printing on the print sheet carried to the print position; and an ejection performance recovery unit M5000 to recover the ink ejection performance of the print unit.

Here, the print unit will be described. The print unit comprises a carriage M4001 movably supported on a carriage shaft M4021 and a print head cartridge H1000 removably mounted on the carriage M4001.

2.1 Print Head Cartridge

First, the print head cartridge used in the print unit will be described with reference to FIGS. 3 to 5.

Figure 3:
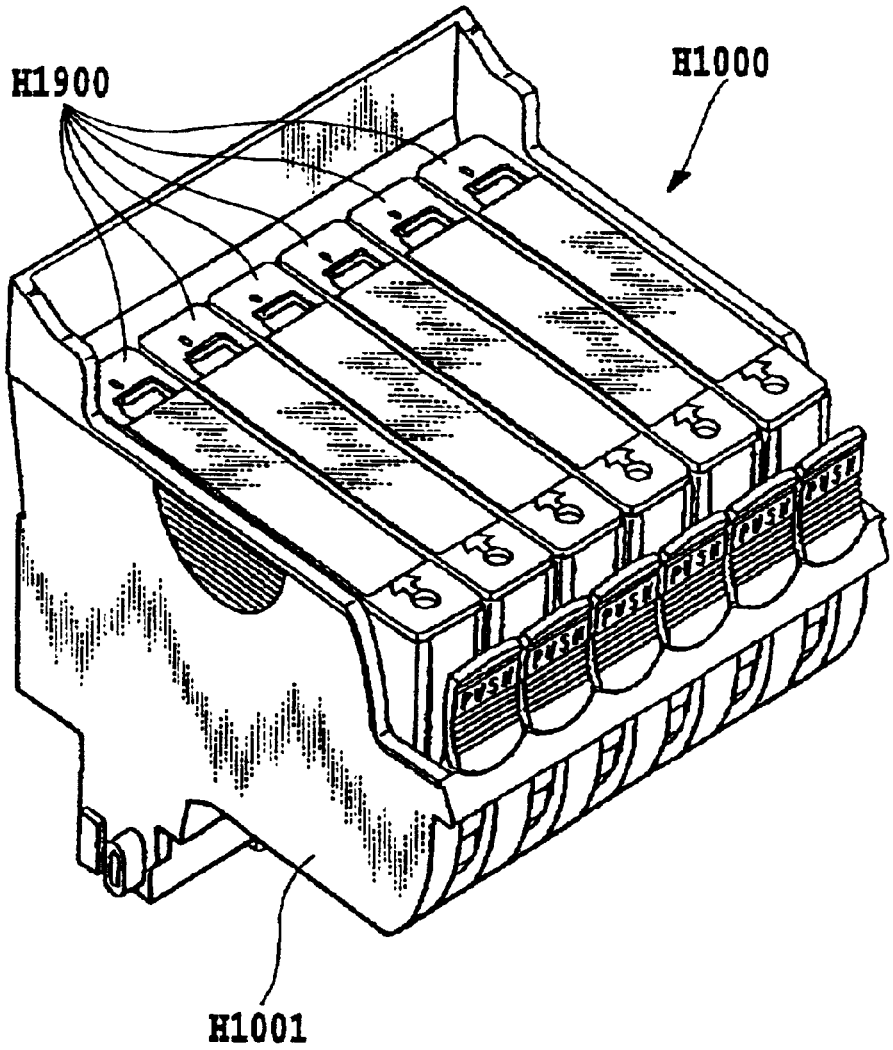
FIG. 3 is a perspective view showing an assembled print head cartridge used in the printer of one embodiment of the present invention.
Figure 4:
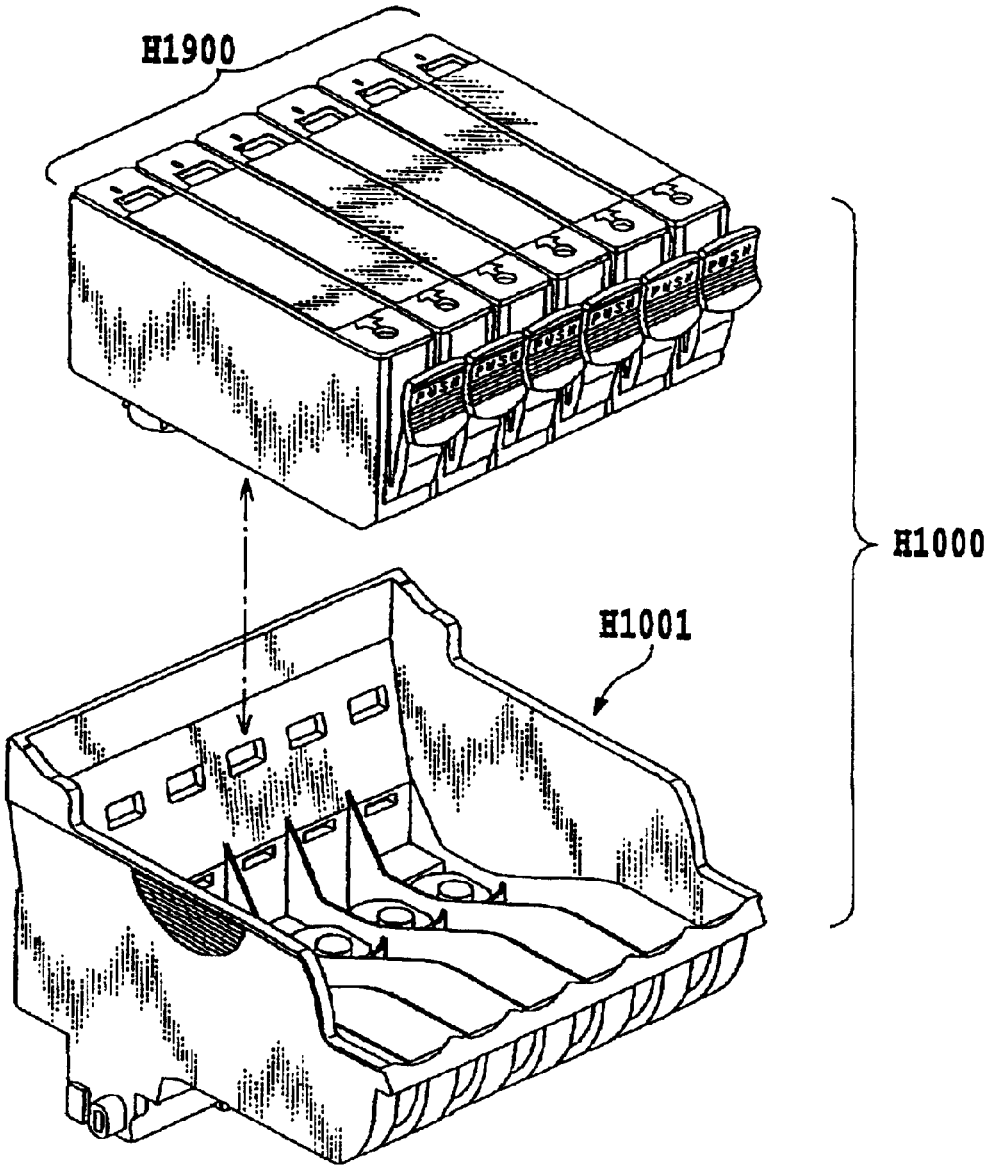
FIG. 4 is an exploded perspective view showing the print head cartridge of FIG. 3.

The print head cartridge H1000 in this embodiment, as shown in FIG. 3, has an ink tank H1900 containing inks and a print head H1001 for ejecting ink supplied from the ink tank H1900 out through nozzles according to print information. The print head H1001 is of a so-called cartridge type in which it is removably mounted to the carriage M4001 described later.

The ink tank for this print head cartridge H1000 consists of separate ink tanks H1900 of, for example, black, light cyan, light magenta, cyan, magenta and yellow to enable color printing with as high an image quality as photograph. As shown in FIG. 4, these individual ink tanks are removably mounted to the print head H1001.

Figure 5:
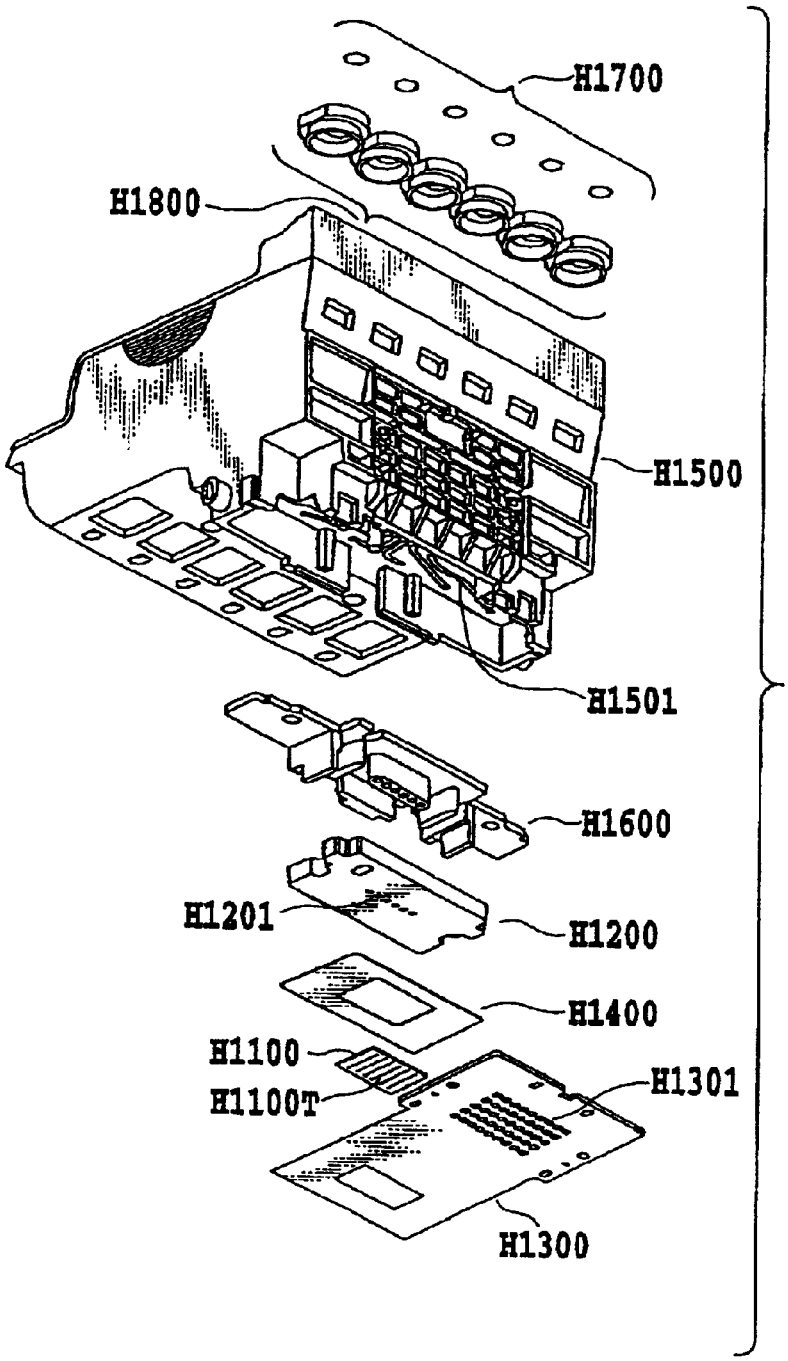
FIG. 5 is an exploded perspective view of the print head of FIG. 4 as seen diagonally below.

Then, the print head H1001, as shown in the perspective view of FIG. 5, comprises a print element substrate H1100, a first plate H1200, an electric wiring board H1300, a second plate H1400, a tank holder H1500, a flow passage forming member H1600, a filter H1700 and a seal rubber H1800.

The print element silicon substrate H1100 has formed in one of its surfaces, by the film deposition technology, a plurality of print elements to produce energy for ejecting ink and electric wires, such as aluminum, for supplying electricity to individual print elements. A plurality of ink passages and a plurality of nozzles H1100T, both corresponding to the print elements, are also formed by the photolithography technology. In the back of the print element substrate H1100, there are formed ink supply ports for supplying ink to the plurality of ink passages. The print element substrate H1100 is securely bonded to the first plate H1200 which is formed with ink supply ports H1201 for supplying ink to the print element substrate H1100. The first plate H1200 is securely bonded with the second plate H1400 having an opening. The second plate H1400 holds the electric wiring board H1300 to electrically connect the electric wiring board H1300 with the print element substrate H1100. The electric wiring board H1300 is to apply electric signals for ejecting ink to the print element substrate H1100, and has electric wires associated with the print element substrate H1100 and external signal input terminals H1301 situated at electric wires' ends for receiving electric signals from the printer body. The external signal input terminals H1301 are positioned and fixed at the back of a tank holder H1500 described later.

The tank holder H1500 that removably holds the ink tank H1900 is securely attached, as by ultrasonic fusing, with the flow passage forming member H1600 to form an ink passage H1501 from the ink tank H1900 to the first plate H1200. At the ink tank side end of the ink passage H1501 that engages with the ink tank H1900, a filter H1700 is provided to prevent external dust from entering. A seal rubber H1800 is provided at a portion where the filter H1700 engages the ink tank H1900, to prevent evaporation of the ink from the engagement portion.

As described above, the tank holder unit, which includes the tank holder H1500, the flow passage forming member H1600, the filter H1700 and the seal rubber H1800, and the print element unit, which includes the print element substrate H1100, the first plate H1200, the electric wiring board H1300 and the second plate H1400, are combined as by adhesives to form the print head H1001.

2.2 Carriage

Next, by referring to FIG. 2, the carriage M4001 carrying the print head cartridge H1000 will be explained.

As shown in FIG. 2, the carriage M4001 has a carriage cover M4002 for guiding the print head H1001 to a predetermined mounting position on the carriage M4001, and a head set lever M4007 that engages and presses against the tank holder H1500 of the print head H1001 to set the print head H1001 at a predetermined mounting position.

That is, the head set lever M4007 is provided at the upper part of the carriage M4001 so as to be pivotable about a head set lever shaft. There is a spring-loaded head set plate (not shown) at an engagement portion where the carriage M4001 engages the print head H1001. With the spring force, the head set lever M4007 presses against the print head H1001 to mount it on the carriage M4001.

At another engagement portion of the carriage M4001 with the print head H1001, there is provided a contact flexible printed cable (see FIG. 7: simply referred to as a contact FPC hereinafter) E0011 whose contact portion electrically contacts a contact portion (external signal input terminals) H1301 provided in the print head H1001 to transfer various information for printing and supply electricity to the print head H1001.

Between the contract portion of the contact FPC E0011 and the carriage M4001 there is an elastic member not shown, such as rubber. The elastic force of the elastic member and the pressing force of the head set lever spring combine to ensure a reliable contact between the contact portion of the contact FPC E0011 and the carriage M4001. Further, the contact FPC E0011 is connected to a carriage substrate E0013 mounted at the back of the carriage M4001 (see FIG. 7).

3. Scanner

The printer of this embodiment can mount a scanner in the carriage M4001 in place of the print head cartridge H1000 and be used as a reading device.

The scanner moves together with the carriage M4001 in the main scan direction, and reads an image on a document fed instead of the printing medium as the scanner moves in the main scan direction. Alternating the scanner reading operation in the main scan direction and the document feed in the sub-scan direction enables one page of document image information to be read.

Figures 6A, 6B:
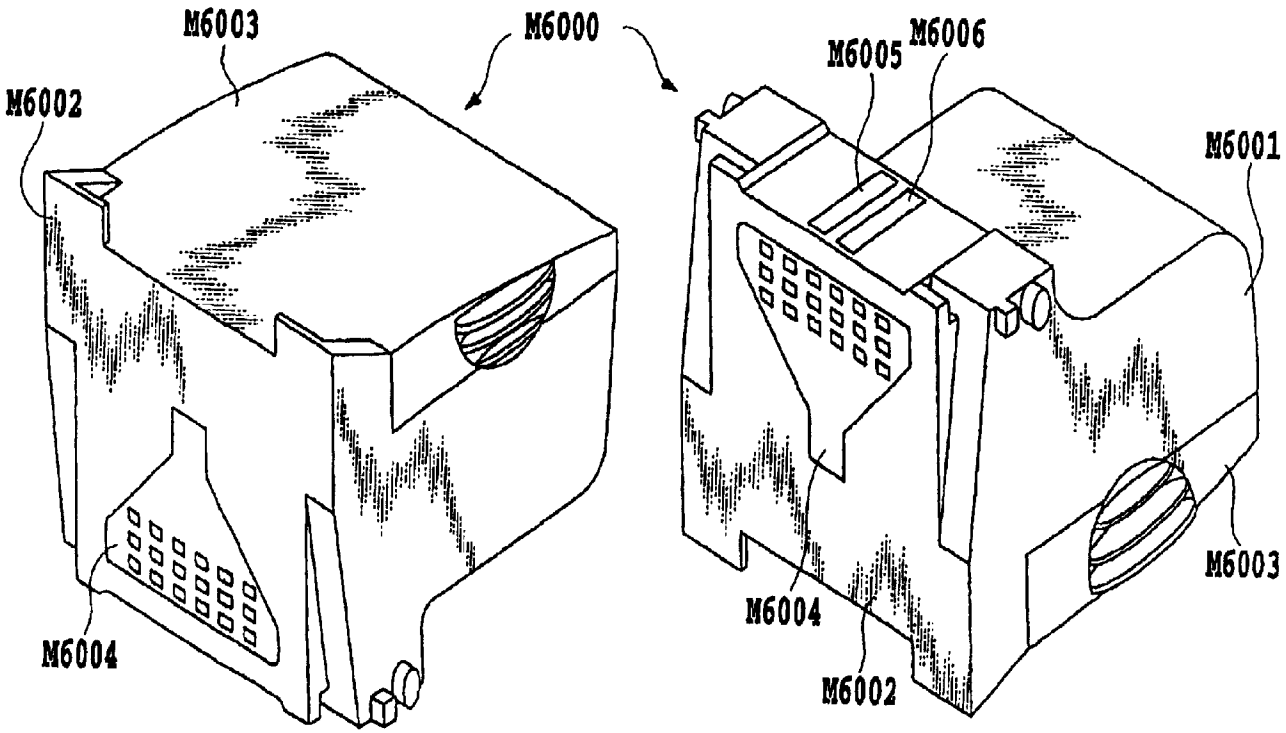
FIGS. 6A and 6B are perspective views showing a construction of a scanner cartridge upside down which can be mounted in the printer of one embodiment of the present invention instead of the print head cartridge of FIG. 3.

FIGS. 6A and 6B show the scanner M6000 upside down to explain about its outline construction.

As shown in the figure, a scanner holder M6001 is shaped like a box and contains an optical system and a processing circuit necessary for reading. A reading lens M6006 is provided at a portion that faces the surface of a document when the scanner M6000 is mounted on the carriage M4001. The lens M6006 focuses light reflected from the document surface onto a reading unit inside the scanner to read the document image. An illumination lens M6005 has a light source not shown inside the scanner. The light emitted from the light source is radiated onto the document through the lens M6005.

The scanner cover M6003 secured to the bottom of the scanner holder M6001 shields the interior of the scanner holder M6001 from light. Louver-like grip portions are provided at the sides to improve the ease with which the scanner can be mounted to and dismounted from the carriage M4001. The external shape of the scanner holder M6001 is almost similar to that of the print head H1001, and the scanner can be mounted to or dismounted from the carriage M4001 in a manner similar to that of the print head H1001.

The scanner holder M6001 accommodates a substrate having a reading circuit, and a scanner contact PCB M6004 connected to this substrate is exposed outside. When the scanner M6000 is mounted on the carriage M4001, the scanner contact PCB M6004 contacts the contact FPC E0011 of the carriage M4001 to electrically connect the substrate to a control system on the printer body side through the carriage M4001.

4. Example Configuration of Printer Electric Circuit

Next, an electric circuit configuration in this embodiment of the invention will be explained.

Figure 7:
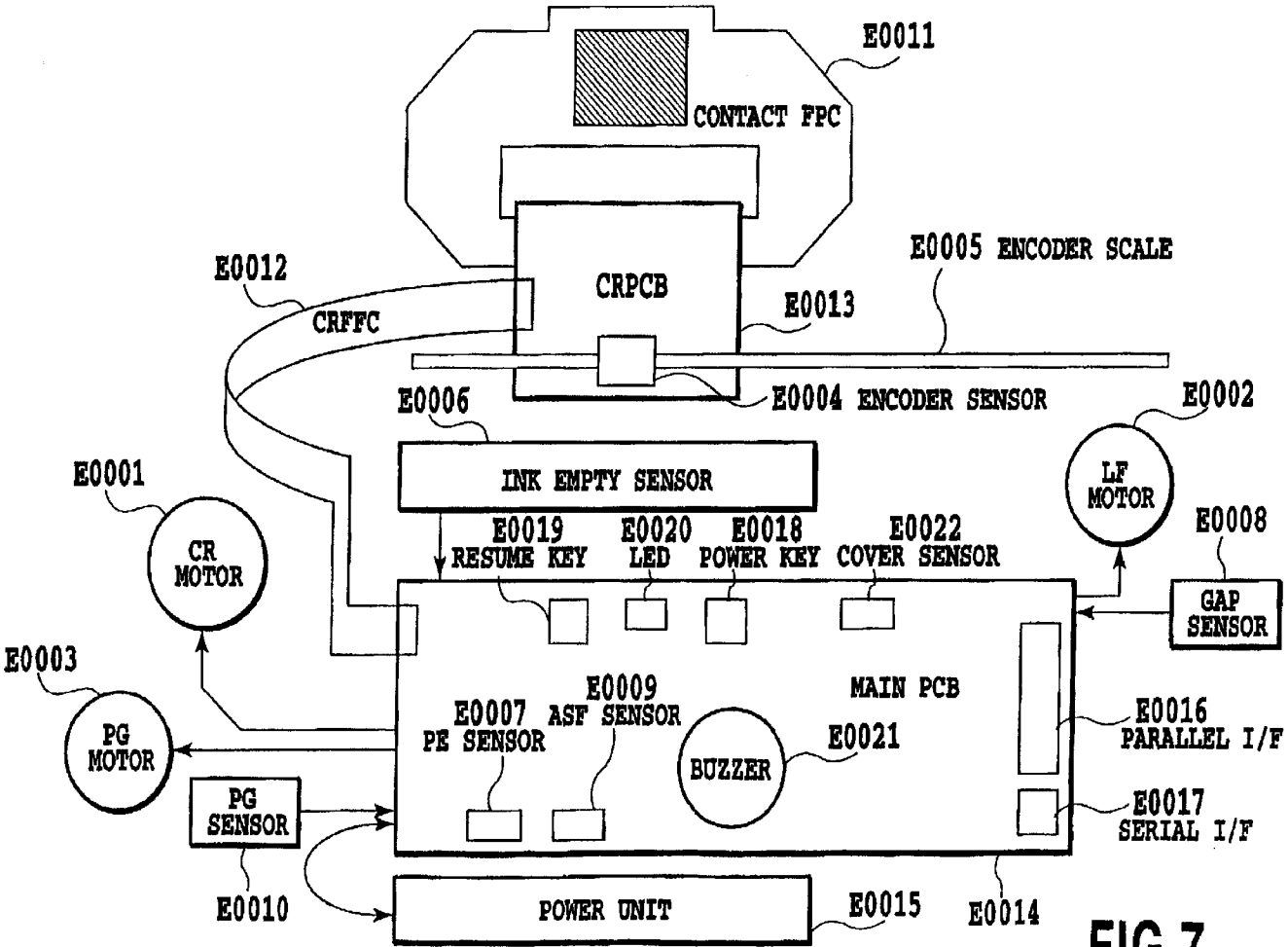
FIG. 7 is a block diagram schematically showing the overall configuration of an electric circuitry of the printer according to one embodiment of the present invention.

FIG. 7 schematically shows the overall configuration of the electric circuit in this embodiment.

The electric circuit in this embodiment comprises mainly a carriage substrate (CRPCB) E0013, a main PCB (printed circuit board) E0014 and a power supply unit E0015.

The power supply unit E0015 is connected to the main PCB E0014 to supply a variety of drive power.

The carriage substrate E0013 is a printed circuit board unit mounted on the carriage M4001 (FIG. 2) and functions as an interface for transferring signals to and from the print head through the contact FPC E0011. In addition, based on a pulse signal output from an encoder sensor E0004 as the carriage M4001 moves, the carriage substrate E0013 detects a change in the positional relation between an encoder scale E0005 and the encoder sensor E0004 and sends its output signal to the main PCB E0014 through a flexible flat cable (CRFFC) E0012.

Further, the main PCB E0014 is a printed circuit board unit that controls the operation of various parts of the ink jet printing apparatus in this embodiment, and has I/O ports for a paper end sensor (PE sensor) E0007, an automatic sheet feeder (ASF) sensor E0009, a cover sensor E0022, a parallel interface (parallel I/F) E0016, a serial interface (Serial I/F) E0017, a resume key E0019, an LED E0020, a power key E0018 and a buzzer E0021. The main PCB E0014 is connected to and controls a motor (CR motor) E0001 that constitutes a drive source for moving the carriage M4001 in the main scan direction; a motor (LF motor) E0002 that constitutes a drive source for transporting the printing medium; and a motor (PG motor) E0003 that performs the functions of recovering the ejection performance of the print head and feeding the printing medium. The main PCB E0014 also has connection interfaces with an ink empty sensor E0006, a gap sensor E0008, a PG sensor E0010, the CRFFC E0012 and the power supply unit E0015.

Figures 8, 8A:
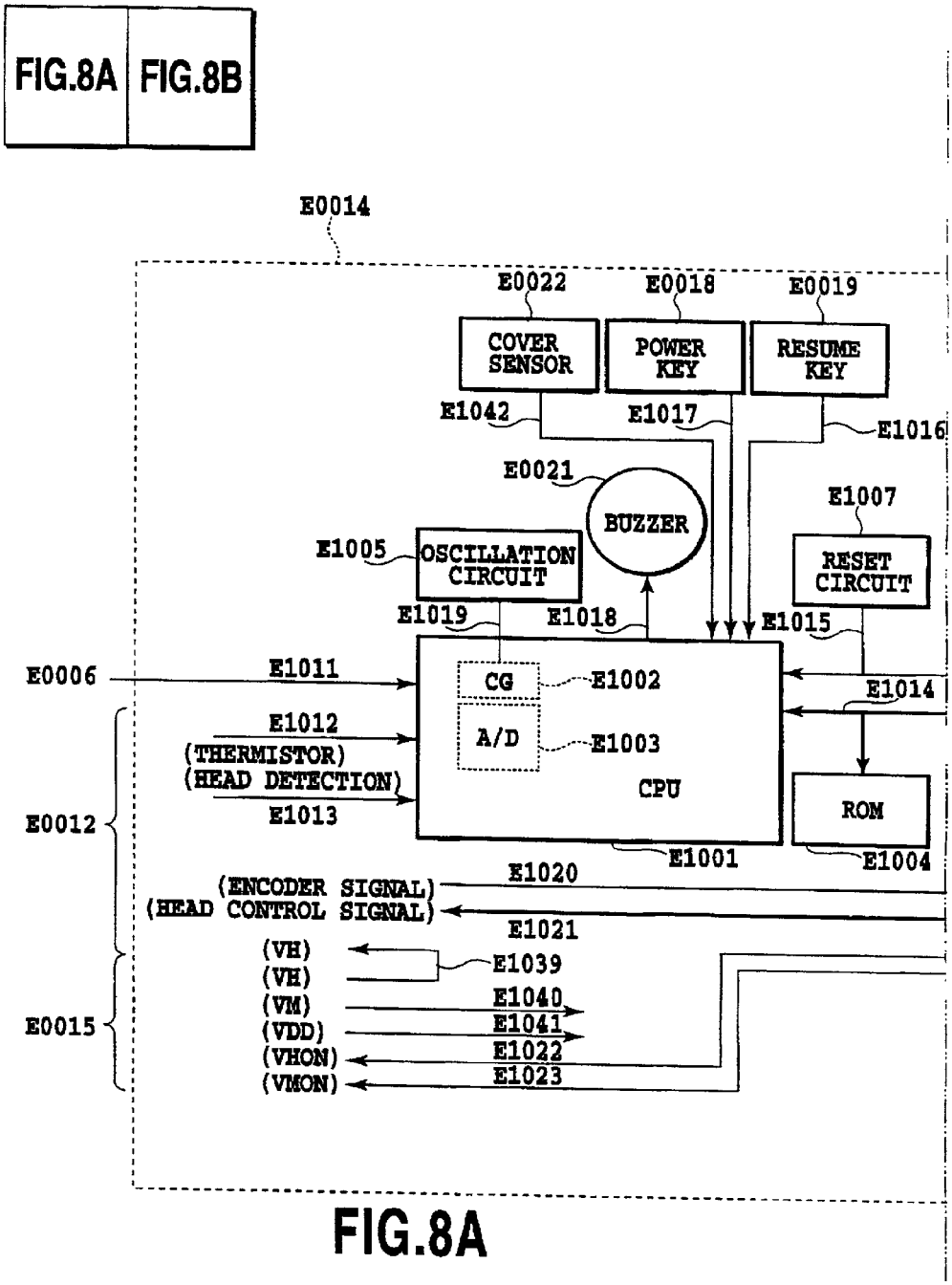
FIG. 8 is a diagram showing the relation between FIGS. 8A and 8B.
FIGS. 8A and 8B being block diagrams representing an example inner configuration of a main printed circuit board (PCB) in the electric circuitry of FIG. 7.
Figure 8B:
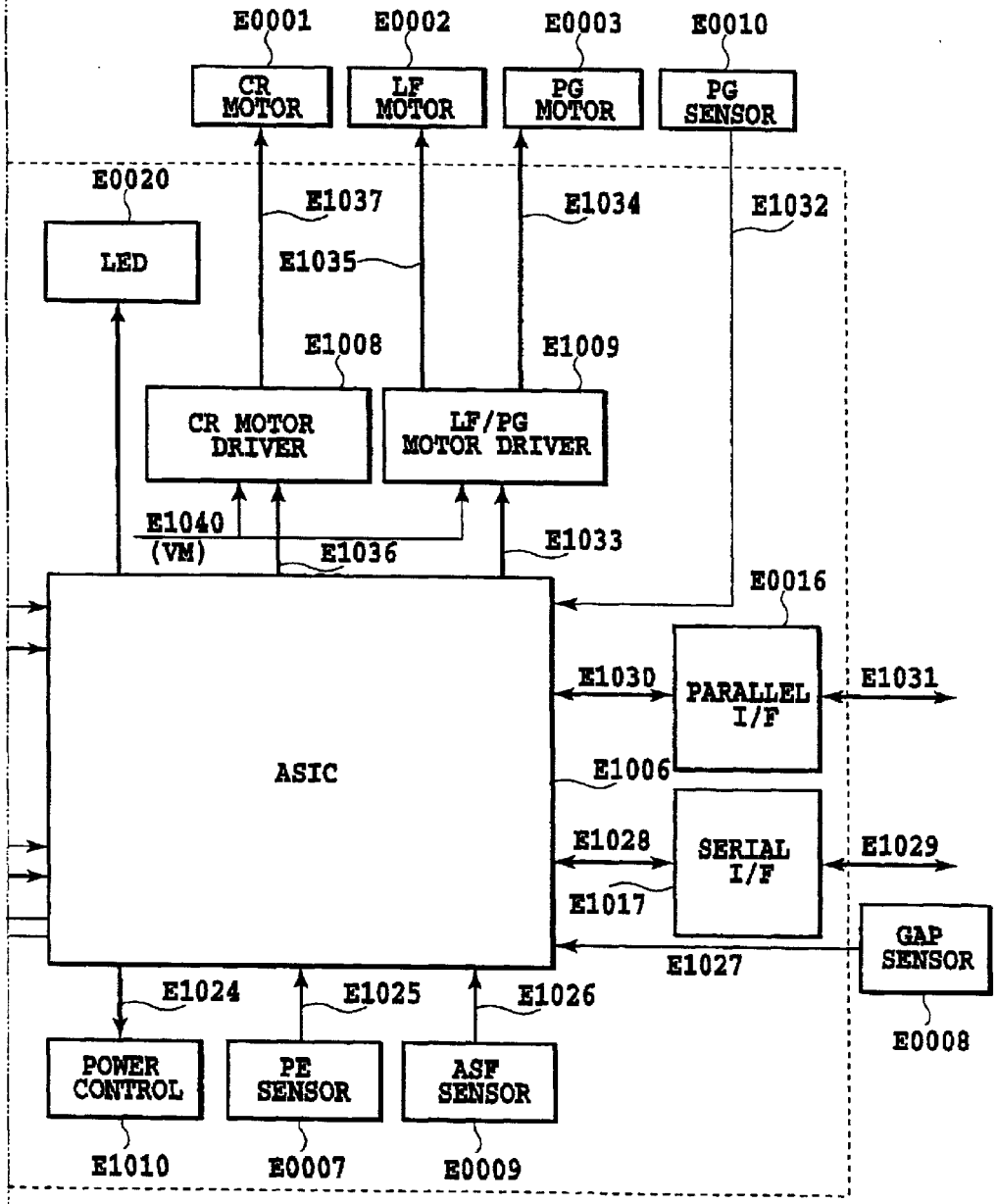

FIG. 8 is a diagram showing the relation between FIGS. 8A and 8B, and FIGS. 8A and 8B are block diagrams showing an inner configuration of the main PCB E0014.

Reference number E1001 represents a CPU, which has a clock generator (CG) E1002 connected to an oscillation circuit E1005 to generate a system clock based on an output signal E1019 of the oscillation circuit E1005. The CPU E1001 is connected to an ASIC (application specific integrated circuit) and a ROM E1004 through a control bus E1014. According to a program stored in the ROM E1004, the CPU E1001 controls the ASIC E1006, checks the status of an input signal E1017 from the power key, an input signal E1016 from the resume key, a cover detection signal E1042 and a head detection signal (HSENS) E1013, drives the buzzer E0021 according to a buzzer signal (BUZ) E1018, and checks the status of an ink empty detection signal (INKS) E1011 connected to a built-in A/D converter E1003 and of a temperature detection signal (TH) E1012 from a thermistor. The CPU E1001 also performs various other logic operations and makes conditional decisions to control the operation of the ink jet printing apparatus.

The head detection signal E1013 is a head mount detection signal entered from the print head cartridge H1000 through the flexible flat cable E0012, the carriage substrate E0013 and the contact FPC E0011. The ink empty detection signal E1011 is an analog signal output from the ink empty sensor E0006. The temperature detection signal E1012 is an analog signal from the thermistor (not shown) provided on the carriage substrate E0013.

Designated E1008 is a CR motor driver that uses a motor power supply (VM) E1040 to generate a CR motor drive signal E1037 according to a CR motor control signal E1036 from the ASIC E1006 to drive the CR motor E0001. E1009 designates an LF/PG motor driver which uses the motor power supply E1040 to generate an LF motor drive signal E1035 according to a pulse motor control signal (PM control signal) E1033 from the ASIC E1006 to drive the LF motor. The LF/PG motor driver E1009 also generates a PG motor drive signal E1034 to drive the PG motor.

Designated E1010 is a power supply control circuit which controls the supply of electricity to respective sensors with light emitting elements according to a power supply control signal E1024 from the ASIC E1006. The parallel I/F E0016 transfers a parallel I/F signal E1030 from the ASIC E1006 to a parallel I/F cable E1031 connected to external circuits and also transfers a signal of the parallel I/F cable E1031 to the ASIC E1006. The serial I/F E0017 transfers a serial I/F signal E1028 from the ASIC E1006 to a serial I/F cable E1029 connected to external circuits, and also transfers a signal from the serial I/F cable E1029 to the ASIC E1006.

The power supply unit E0015 provides a head power signal (VH) E1039, a motor power signal (VM) E1040 and a logic power signal (VDD) E1041. A head power ON signal (VHON) E1022 and a motor power ON signal (VMON) E1023 are sent from the ASIC E1006 to the power supply unit E0015 to perform the ON/OFF control of the head power signal E1039 and the motor power signal E1040. The logic power signal (VDD) E1041 supplied from the power supply unit E0015 is voltage-converted as required and given to various parts inside or outside the main PCB E0014.

The head power signal E1039 is smoothed by a circuit of the main PCB E0014 and then sent out to the flexible flat cable E0011 to be used for driving the print head cartridge H100. E1007 denotes a reset circuit which detects a reduction in the logic power signal E1041 and sends a reset signal (RESET) to the CPU E1001 and the ASIC E1006 to initialize them.

The ASIC E1006 is a single-chip semiconductor integrated circuit and is controlled by the CPU E1001 through the control bus E1014 to output the CR motor control signal E1036, the PM control signal E1033, the power supply control signal E1024, the head power ON signal E1022 and the motor power ON signal E1023. It also transfers signals to and from the parallel interface E0016 and the serial interface E0017. In addition, the ASIC E1006 detects the status of a PE detection signal (PES) E1025 from the PE sensor E0007, an ASF detection signal (ASFS) E1026 from the ASF sensor E0009, a gap detection signal (GAPS) E1027 from the GAP sensor E0008 for detecting a gap between the print head and the printing medium, and a PG detection signal (PGS) E1032 from the PG sensor E0010, and sends data representing the statuses of these signals to the CPU E1001 through the control bus E1014. Based on the data received, the CPU E1001 controls the operation of an LED drive signal E1038 to turn on or off the LED E0020.

Further, the ASIC E1006 checks the status of an encoder signal (ENC) E1020, generates a timing signal, interfaces with the print head cartridge H1000 and controls the print operation by a head control signal E1021. The encoder signal (ENC) E1020 is an output signal of the CR encoder sensor E0004 received through the flexible flat cable E0012. The head control signal E1021 is sent to the print head H1001 through the flexible flat cable E0012, carriage substrate E0013 and contact FPC E0011.

Figures 9, 9A:
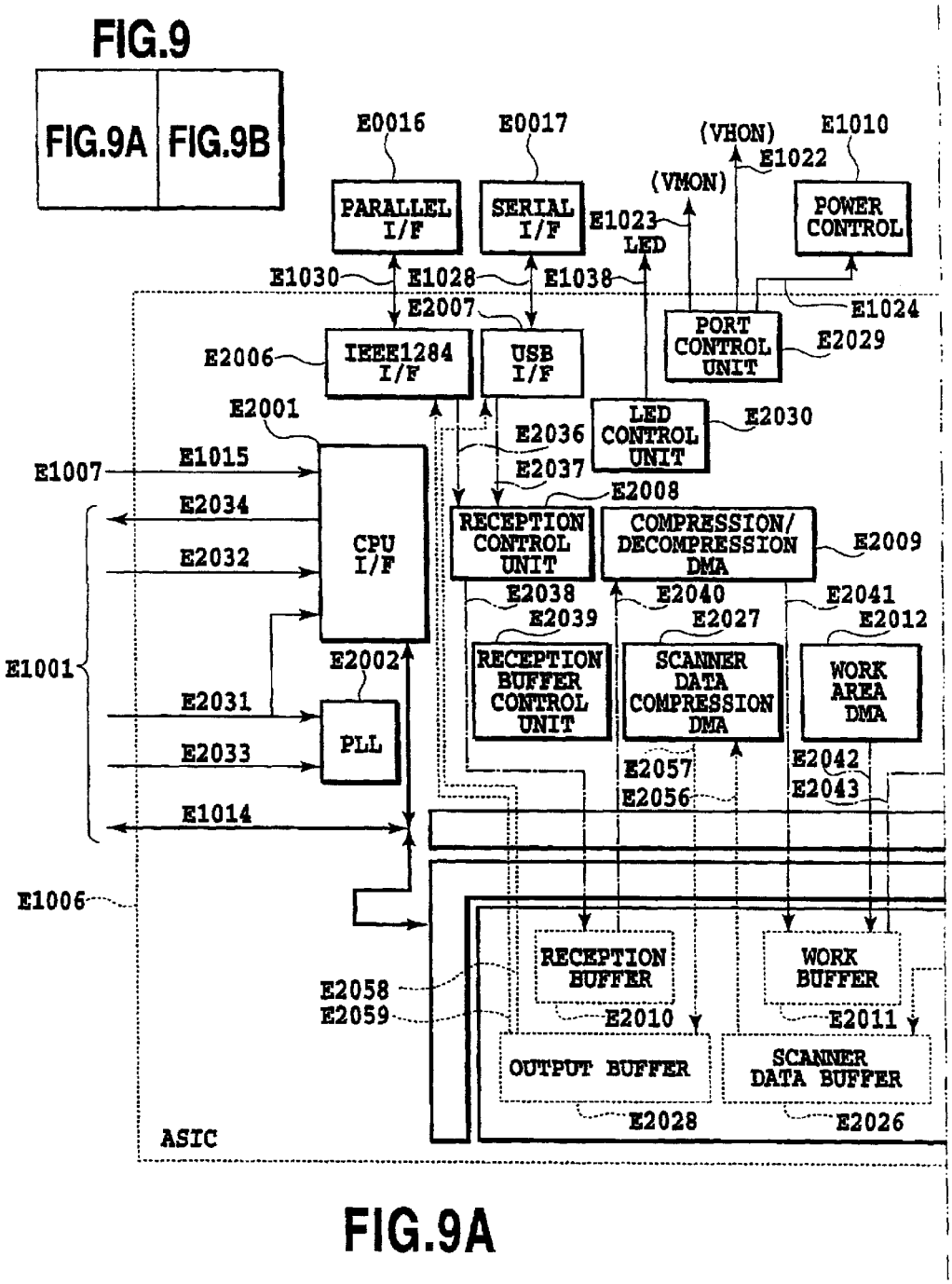
FIG. 9 is a diagram showing the relation between FIGS. 9A and 9B.
FIGS. 9A and 9B being block diagrams representing an example inner configuration of an application specific integrated circuit (ASIC) in the main PCB of FIGS. 8A and 8B.
Figure 9B:
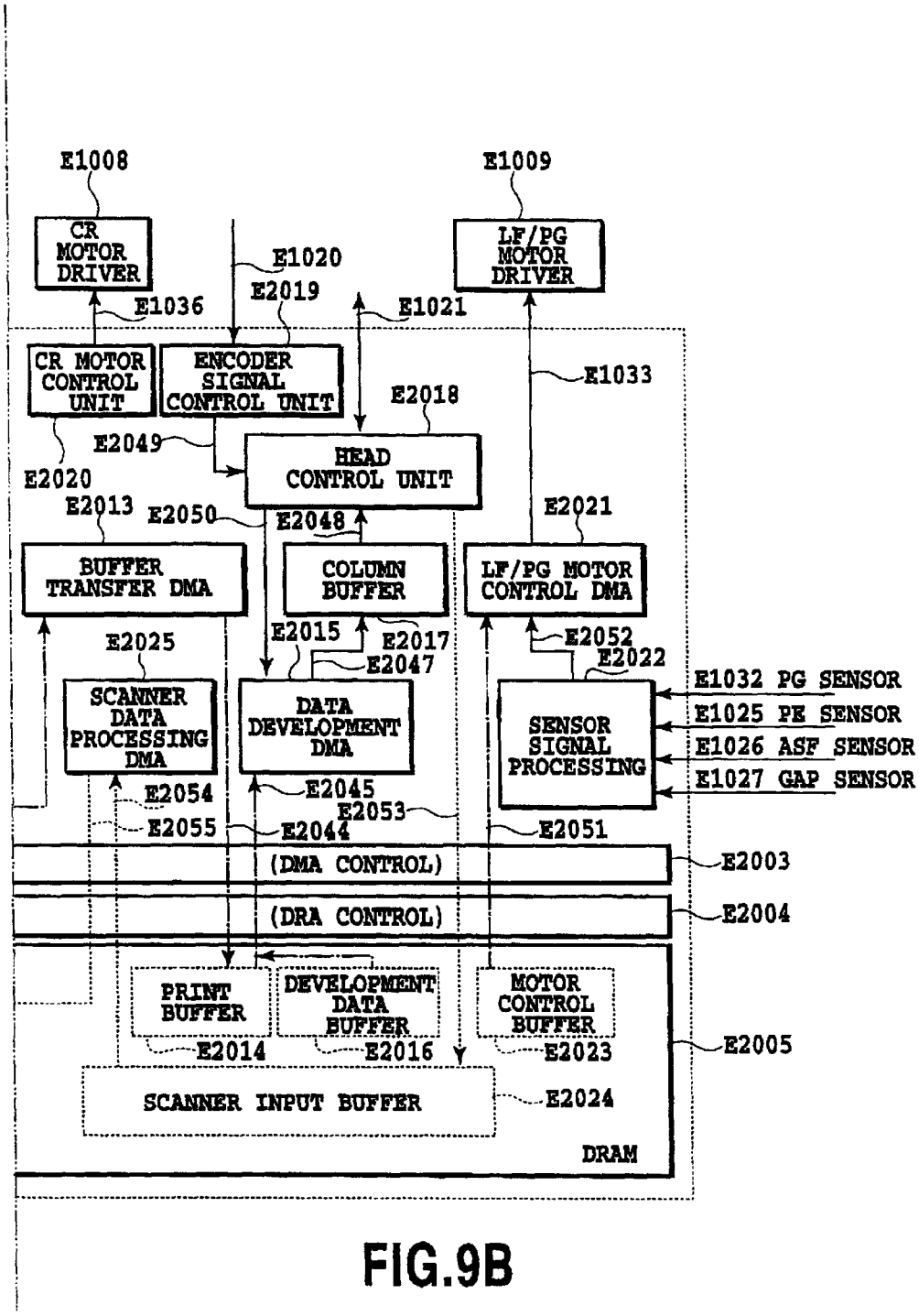

FIG. 9 is a diagram showing the relation between FIGS. 9A and 9B, and FIGS. 9A and 9B are block diagrams showing an example internal configuration of the ASIC E1006.

In these figures, only the flow of data, such as print data and motor control data, associated with the control of the head and various mechanical components is shown between each block, and control signals and clock associated with the read/write operation of the registers incorporated in each block and control signals associated with the DMA control are omitted to simplify the drawing.

In the figures, reference number E2002 represents a PLL controller which, based on a clock signal (CLK) E2031 and a PLL control signal (PLLON) E2033 output from the CPU E1001, generates a clock (not shown) to be supplied to the most part of the ASIC E1006.

Denoted E2001 is a CPU interface (CPU I/F) E2001, which controls the read/write operation of register in each block, supplies a clock to some blocks and accepts an interrupt signal (none of these operations are shown) according to a reset signal E1015, a software reset signal (PDWN) E2032 and a clock signal (CLK) E2031 output from the CPU E1001, and control signals from the control bus E1014. The CPU I/F E2001 then outputs an interrupt signal (INT) E2034 to the CPU E1001 to inform it of the occurrence of an interrupt within the ASIC E1006.

E2005 denotes a DRAM which has various areas for storing print data, such as a reception buffer E2010, a work buffer E2011, a print buffer E2014 and a development data buffer E2016. The DRAM E2005 also has a motor control buffer E2023 for motor control and, as buffers used instead of the above print data buffers during the scanner operation mode, a scanner input buffer E2024, a scanner data buffer E2026 and an output buffer E2028.

The DRAM E2005 is also used as a work area by the CPU E1001 for its own operation. Designated E2004 is a DRAM control unit E2004 which performs read/write operations on the DRAM E2005 by switching between the DRAM access from the CPU E1001 through the control bus and the DRAM access from a DMA control unit E2003 described later.

The DMA control unit E2003 accepts request signals (not shown) from various blocks and outputs address signals and control signals (not shown) and, in the case of write operation, write data E2038, E2041, E2044, E2053, E2055, E2057 etc. to the DRAM control unit to make DRAM accesses. In the case of read operation, the DMA control unit E2003 transfers the read data E2040, E2043, E2045, E2051, E2054, E2056, E2058, E2059 from the DRAM control unit E2004 to the requesting blocks.

Denoted E2006 is an IEEE 1284 I/F which functions as a bi-directional communication interface with external host devices, not shown, through the parallel I/F E0016 and is controlled by the CPU E1001 via CPU I/F E2001. During the printing operation, the IEEE 1284 I/F E2006 transfers the receive data (PIF receive data E2036) from the parallel I/F E0016 to a reception control unit E2008 by the DMA processing. During the scanner reading operation, the 1284 I/F E2006 sends the data (1284 transmit data (RDPIF) E2059) stored in the output buffer E2028 in the DRAM E2005 to the parallel I/F E0016 by the DMA processing.

Designated E2007 is a universal serial bus (USB) I/F which offers a bi-directional communication interface with external host devices, not shown, through the serial I/F E0017 and is controlled by the CPU E1001 through the CPU I/F E2001. During the printing operation, the universal serial bus (USB) I/F E2007 transfers received data (USB receive data E2037) from the serial I/F E0017 to the reception control unit E2008 by the DMA processing. During the scanner reading, the universal serial bus (USB) I/F E2007 sends data (USB transmit data (RDUSB) E2058) stored in the output buffer E2028 in the DRAM E2005 to the serial I/F E0017 by the DMA processing. The reception control unit E2008 writes data (WDIF E2038) received from the 1284 I/F E2006 or universal serial bus (USB) I/F E2007, whichever is selected, into a reception buffer write address managed by a reception buffer control unit E2039.

Designated E2009 is a compression/decompression DMA controller which is controlled by the CPU E1001 through the CPU I/F E2001 to read received data (raster data) stored in a reception buffer E2010 from a reception buffer read address managed by the reception buffer control unit E2039, compress or decompress the data (RDWK) E2040 according to a specified mode, and write the data as a print code string (WDWK) E2041 into the work buffer area.

Designated E2013 is a print buffer transfer DMA controller which is controlled by the CPU E1001 through the CPU I/F E2001 to read print codes (RDWP) E2043 on the work buffer E2011 and rearrange the print codes onto addresses on the print buffer E2014 that match the sequence of data transfer to the print head cartridge H1000 before transferring the codes (WDWP E2044). Reference number E2012 denotes a work area DMA controller which is controlled by the CPU E1001 through the CPU I/F E2001 to repetitively write specified work fill data (WDWF) E2042 into the area of the work buffer whose data transfer by the print buffer transfer DMA controller E2013 has been completed.

Designated E2015 is a print data development DMA controller E2015, which is controlled by the CPU E1001 through the CPU I/F E2001. Triggered by a data development timing signal E2050 from a head control unit E2018, the print data development DMA controller E2015 reads the print code that was rearranged and written into the print buffer and the development data written into the development data buffer E2016 and writes developed print data (RDHDG) E2045 into the column buffer E2017 as column buffer write data (WDHDG) E2047. The column buffer E2017 is an SRAM that temporarily stores the transfer data (developed print data) to be sent to the print head cartridge H1000, and is shared and managed by both the print data development DMA CONTROLLER and the head control unit through a handshake signal (not shown).

Designated E2018 is a head control unit E2018 which is controlled by the CPU E1001 through the CPU I/F E2001 to interface with the print head cartridge H1000 or the scanner through the head control signal. It also outputs a data development timing signal E2050 to the print data development DMA controller according to a head drive timing signal E2049 from the encoder signal processing unit E2019.

During the printing operation, the head control unit E2018, when it receives the head drive timing signal E2049, reads developed print data (RDHD) E2048 from the column buffer and outputs the data to the print head cartridge H1000 as the head control signal E1021.

In the scanner reading mode, the head control unit E2018 DMA-transfers the input data (WDHD) E2053 received as the head control signal E1021 to the scanner input buffer E2024 on the DRAM E2005. Designated E2025 is a scanner data processing DMA controller E2025 which is controlled by the CPU E1001 through the CPU I/F E2001 to read input buffer read data (RDAV) E2054 stored in the scanner input buffer E2024 and writes the averaged data (WDAV) E2055 into the scanner data buffer E2026 on the DRAM E2005.

Designated E2027 is a scanner data compression DMA controller which is controlled by the CPU E1001 through the CPU I/F E2001 to read processed data (RDYC) E2056 on the scanner data buffer E2026, perform data compression, and write the compressed data (WDYC) E2057 into the output buffer E2028 for transfer.

Designated E2019 is an encoder signal processing unit which, when it receives an encoder signal (ENC), outputs the head drive timing signal E2049 according to a mode determined by the CPU E1001. The encoder signal processing unit E2019 also stores in a register information on the position and speed of the carriage M4001 obtained from the encoder signal E1020 and presents it to the CPU E1001. Based on this information, the CPU E1001 determines various parameters for the CR motor E0001. Designated E2020 is a CR motor control unit which is controlled by the CPU E1001 through the CPU I/F E2001 to output the CR motor control signal E1036.

Denoted E2022 is a sensor signal processing unit which receives detection signals E1032, E1025, E1026 and E1027 output from the PG sensor E0010, the PE sensor E0007, the ASF sensor E0009 and the gap sensor E0008, respectively, and transfers these sensor information to the CPU E1001 according to the mode determined by the CPU E1001. The sensor signal processing unit E2022 also outputs a sensor detection signal E2052 to a DMA controller E2021 for controlling LF/PG motor.

The DMA controller E2021 for controlling LF/PG motor is controlled by the CPU E1001 through the CPU I/F E2001 to read a pulse motor drive table (RDPM) E2051 from the motor control buffer E2023 on the DRAM E2005 and output a pulse motor control signal E1033. Depending on the operation mode, the controller outputs the pulse motor control signal E1033 upon reception of the sensor detection signal as a control trigger.

Designated E2030 is an LED control unit which is controlled by the CPU E1001 through the CPU I/F E2001 to output an LED drive signal E1038. Further, designated E2029 is a port control unit which is controlled by the CPU E1001 through the CPU I/F E2001 to output the head power ON signal E1022, the motor power ON signal E1023 and the power supply control signal E1024.

5. Operation of Printer

Figure 10:
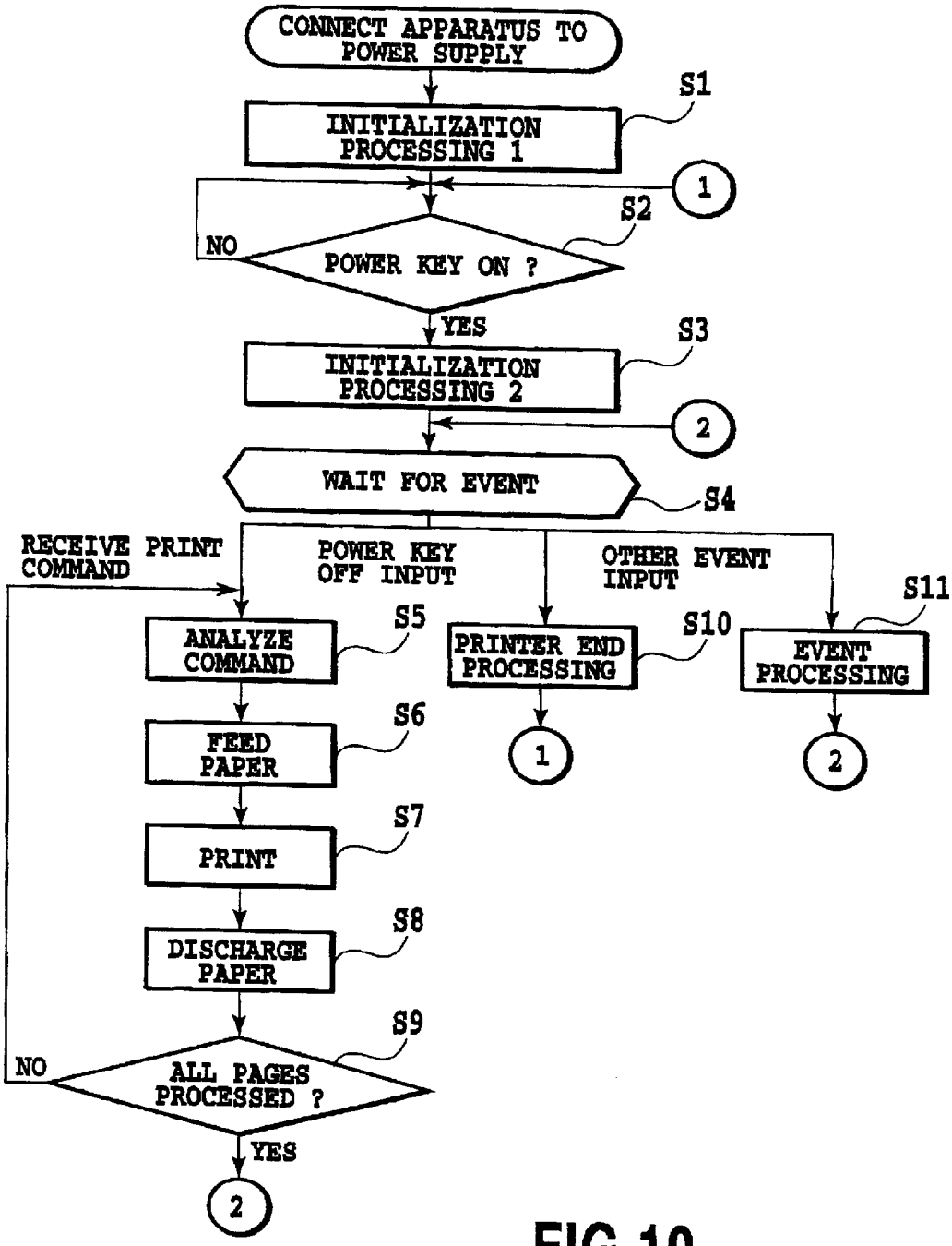
FIG. 10 is a flow chart showing an example of operation of the printer as one embodiment of the present invention.
Figure 11:
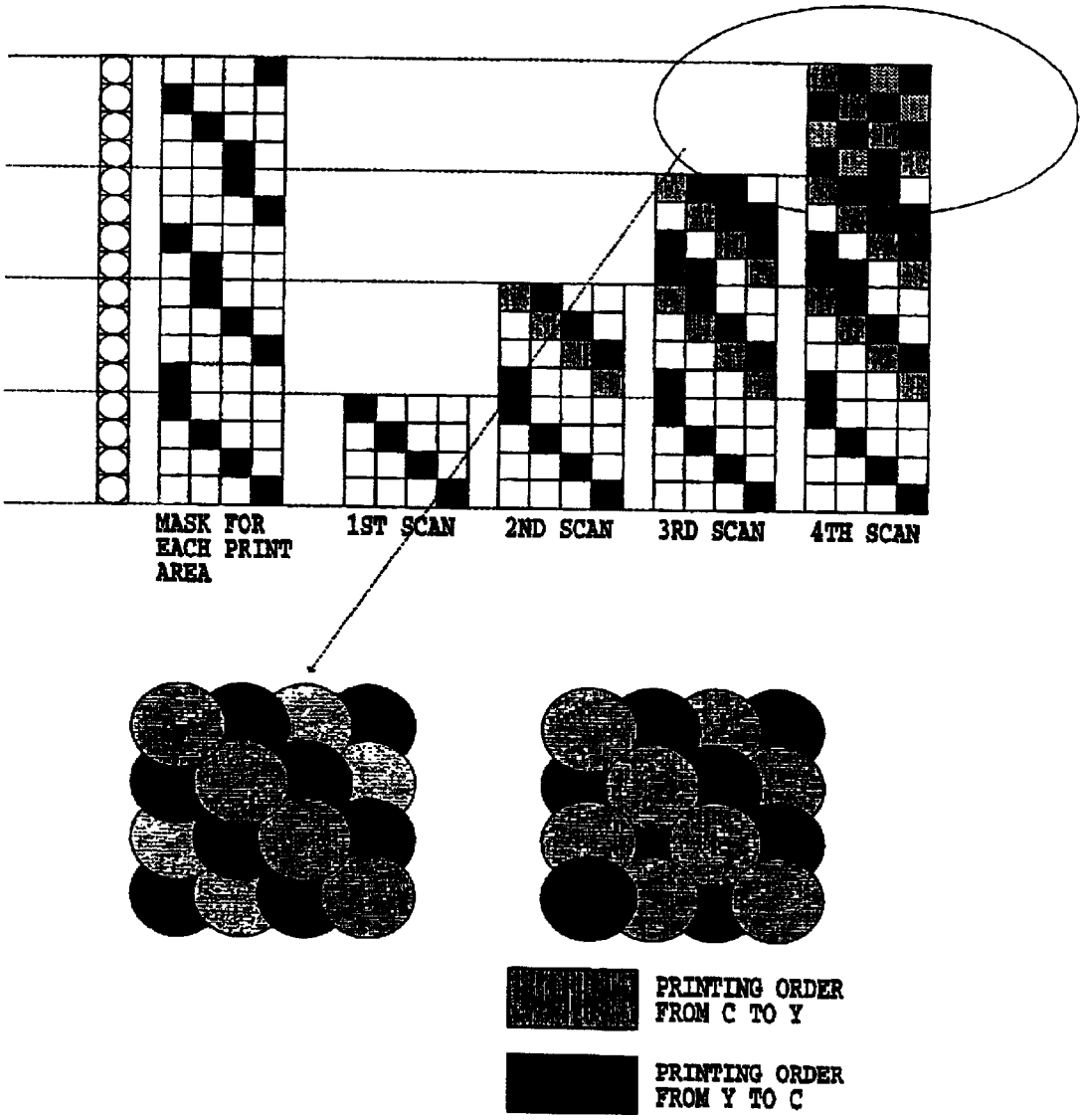
FIG. 11 is an explanatory diagram microscopically showing a mechanism by which color variations are caused by a change in the printing order of inks when bi-directional printing is performed by an ink jet printing apparatus.
Figure 12:
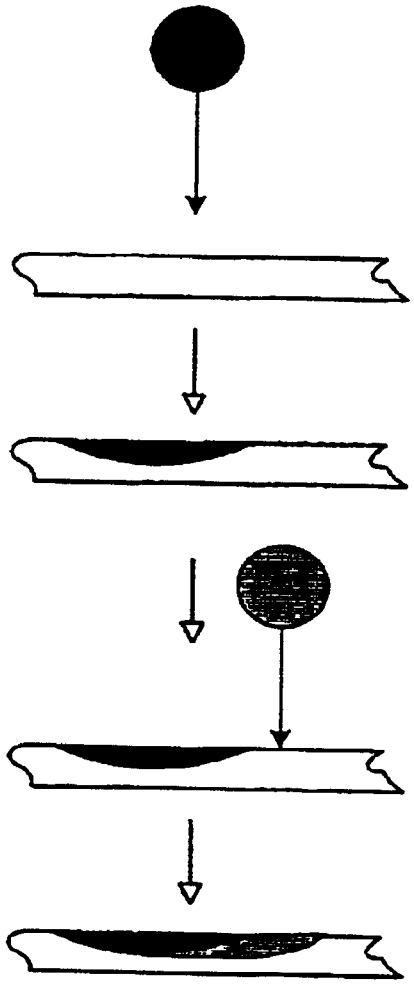
FIG. 12 is an explanatory diagram showing how ink droplets soak into a print medium.
Figure 13:
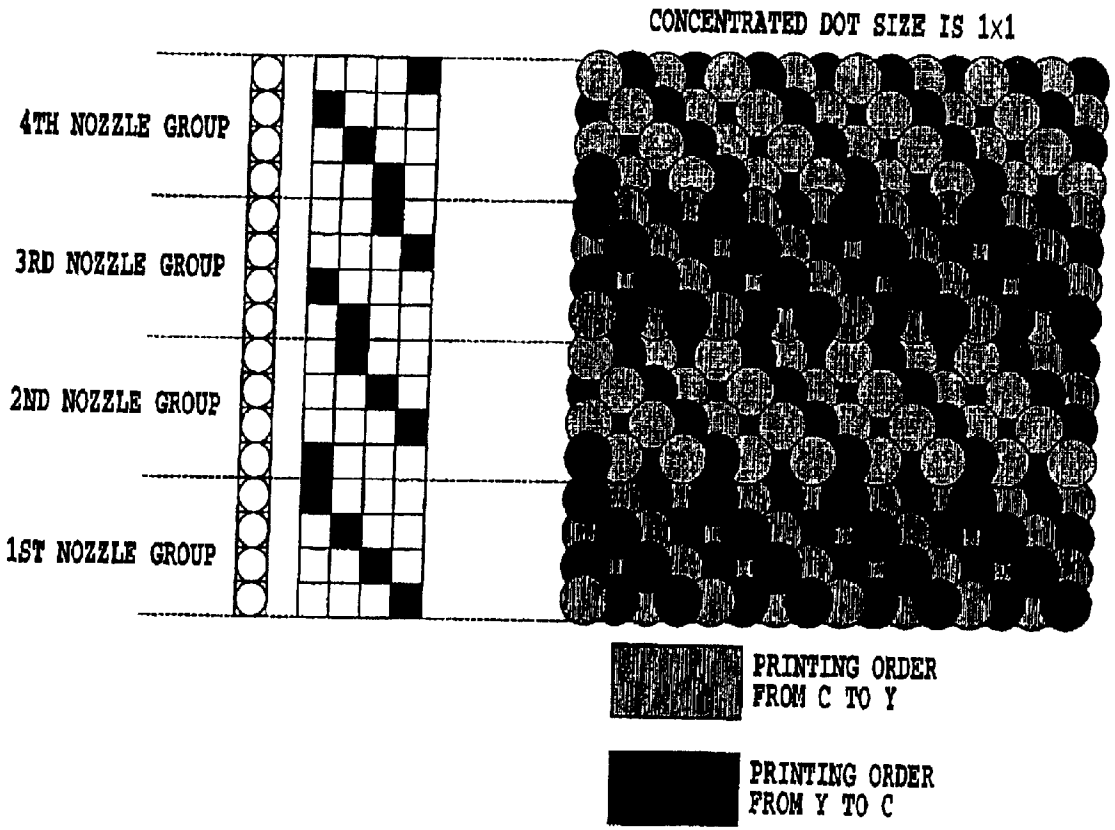
FIG. 13 is an explanatory diagram macroscopically showing a mechanism by which color variations are caused by a change in the printing order of inks during bi-directional printing.

Next, the operation of the ink jet printing apparatus in this embodiment of the invention with the above configuration will be explained by referring to the flow chart of FIG. 10.

When the printer body M1000 is connected to an AC power supply, a first initialization is performed at step S1. In this initialization process, the electric circuit system including the ROM and RAM in the apparatus is checked to confirm that the apparatus is electrically operable.

Next, step S2 checks if the power key E0018 on the upper case M1002 of the printer body M1000 is turned on. When it is decided that the power key E0018 is pressed, the processing moves to the next step S3 where a second initialization is performed.

In this second initialization, a check is made of various drive mechanisms and the print head of this apparatus. That is, when various motors are initialized and head information is read, it is checked whether the apparatus is normally operable.

Next, steps S4 waits for an event. That is, this step monitors a demand event from the external I/F, a panel key event from the user operation and an internal control event and, when any of these events occurs, executes the corresponding processing.

When, for example, step S4 receives a print command event from the external I/F, the processing moves to step S5. When a power key event from the user operation occurs at step S4, the processing moves to step S10. If another event occurs, the processing moves to step S11.

Step S5 analyzes the print command from the external I/F, checks a specified paper kind, paper size, print quality, paper feeding method and others, and stores data representing the check result into the DRAM E2005 of the apparatus before proceeding to step S6.

Next, step S6 starts feeding the paper according to the paper feeding method specified by the step S5 until the paper is situated at the print start position. The processing moves to step S7.

At step S7 the printing operation is performed. In this printing operation, the print data sent from the external I/F is stored temporarily in the print buffer. Then, the CR motor E0001 is started to move the carriage M4001 in the main-scanning direction. At the same time, the print data stored in the print buffer E2014 is transferred to the print head H1001 to print one line. When one line of the print data has been printed, the LF motor E0002 is driven to rotate the LF roller M3001 to transport the paper in the sub-scanning direction. After this, the above operation is executed repetitively until one page of the print data from the external I/F is completely printed, at which time the processing moves to step S8.

At step S8, the LF motor E0002 is driven to rotate the paper discharge roller M2003 to feed the paper until it is decided that the paper is completely fed out of the apparatus, at which time the paper is completely discharged onto the paper discharge tray M1004.

Next at step S9, it is checked whether all the pages that need to be printed have been printed and if there are pages that remain to be printed, the processing returns to step S5 and the steps S5 to S9 are repeated. When all the pages that need to be printed have been printed, the print operation is ended and the processing moves to step S4 waiting for the next event.

Step S10 performs the printing termination processing to stop the operation of the apparatus. That is, to turn off various motors and print head, this step renders the apparatus ready to be cut off from power supply and then turns off power, before moving to step S4 waiting for the next event.

Step S11 performs other event processing. For example, this step performs processing corresponding to the ejection performance recovery command from various panel keys or external I/F and the ejection performance recovery event that occurs internally. After the recovery processing is finished, the printer operation moves to step S4 waiting for the next event.

One form in which the present invention is effectively implemented is the one in which thermal energy produced by an electrothermal transducer is used to cause a film boiling in a liquid and thereby form a bubble.

Next, embodiments with configurations characteristic of this invention will be described.

(First Embodiment)

A first embodiment of this invention will be explained as follows.

Figure 14:
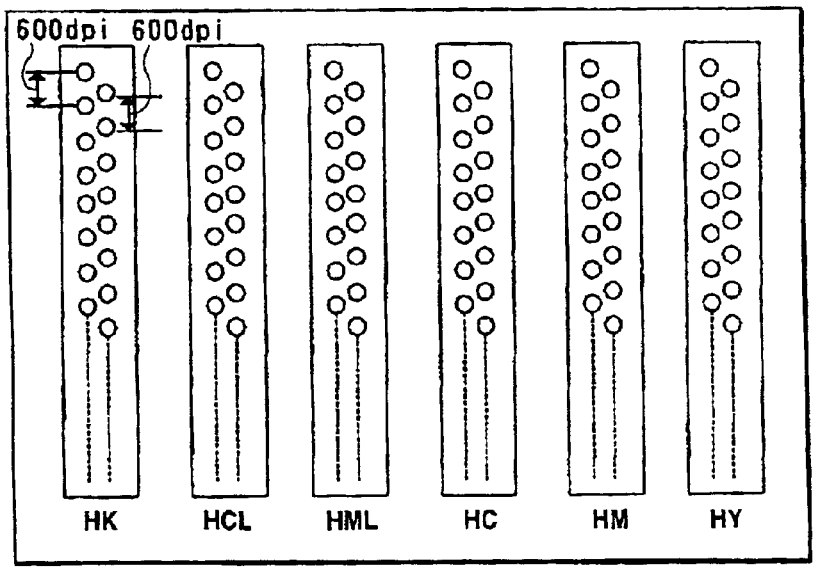
FIG. 14 is an explanatory view showing the construction of print heads used in a first embodiment of the invention.

FIG. 14 shows example configuration and arrangement of the heads used in this embodiment. Here, a total of six print heads for four ordinary colors—C (cyan), M (magenta), Y (yellow) and K (black)—and light C and light M are mounted on a carriage. The print heads are arranged in a so-called lateral configuration in which they are arranged in line in a main scan direction (the direction in which the carriage moves). Each of the print heads has two columns of nozzles formed therein to extend along a (vertical) direction perpendicular to the main scan direction. Each of the two nozzle columns has a large number of nozzles (e.g., 255 nozzles) arrayed at a pitch of 600 dpi. It is noted that since the two nozzle columns are staggered by one-half pixel, each print head has an equivalent configuration in which the nozzles are arrayed in a single vertical column at a 1200-dpi pitch.

This embodiment employs a four-pass printing system in which an image is completed by performing four main scans (four passes) of the print heads using the different nozzle groups over the same print area on the print medium.

Figure 15:
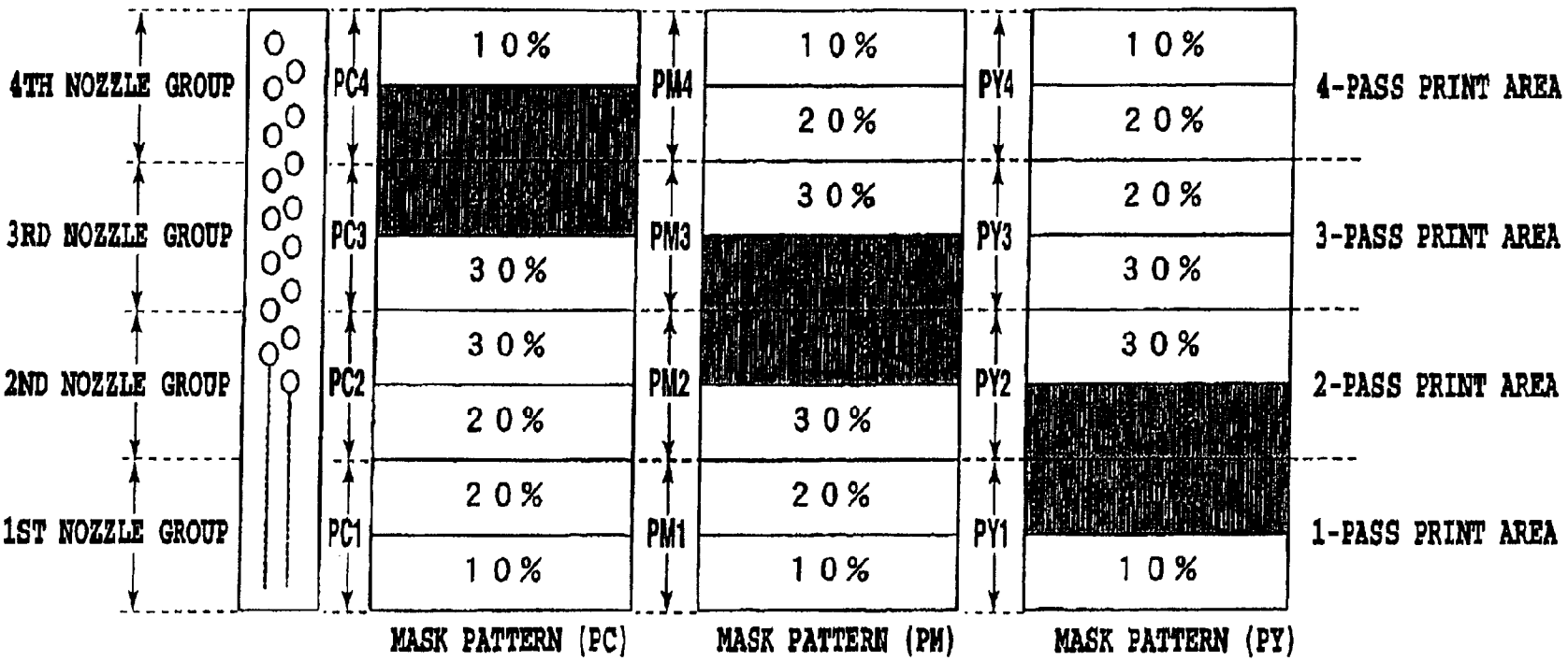
FIG. 15 is an explanatory view showing print duties set for individual print heads in the first embodiment of the invention.

FIG. 15 schematically shows the print duties of each nozzle group when the 4-pass printing is executed using the print heads C, M, Y. As shown in the figure, each print head has first to fourth nozzle groups, the width in a longitudinal direction of each nozzle group, that is, the width of each print area printed by each nozzle group being equal to distance that the print medium is fed in the sub-scan direction after each pass (feed distance). The print duties of each nozzle group in each print head are determined by mask patterns PC, PM, PY that thin out the print data supplied to the print heads C, M, Y. The mask patterns PC, PM, PY each have mask areas corresponding to the nozzle groups. That is, each mask pattern has mask areas corresponding to the print scans of the first to fourth passes. In the figure PC1 to PC4 represent mask areas in the mask pattern PC, PM1 to PM4 represent mask areas in the mask pattern PM, and PY1 to PY4 represent mask areas in the mask pattern PY. The mask areas PC1–PC4, PM1–PM4, and PY1–PY4 correspond to the first to fourth nozzle groups.

Further, in this embodiment the print duty set in each mask area is divided in two in the sub-scan direction.

In the mask pattern PC, for example, the print duty set in the mask area PC1 corresponding to the first pass of the printing scan is 10% in a second half, with respect to the paper feed direction, of the mask area PC1 and 20% in a first half; the print duty set in the mask area PC2 corresponding to the second pass is 20% in a second half and 30% in a first half; the print duty set in the mask area PC3 corresponding to the third pass is 30% in a second half and 40% in a first half; and the print duty set in the mask area PC4 corresponding to the fourth pass is 40% in a second half and 10% in a first half.

In the mask pattern PM, the print duty set in the mask area PM1 corresponding to the first pass of the printing scan is 10% in a second half, with respect to the paper feed direction, of the mask area PM1 and 20% in a first half; the print duty set in the mask area PM2 corresponding to the second pass is 30% in a second half and 40% in a first half; the print duty set in the mask area PM3 corresponding to the third pass is 40% in a second half and 30% in a first half; and the print duty set in the mask area PM4 corresponding to the fourth pass is 20% in a second half and 10% in a first half.

Further, in the mask pattern PY, the print duty set in the mask area PY1 corresponding to the first pass of the printing scan is 10% in a second half, with respect to the paper feed direction, of the mask area PY1 and 40% in a first half; the print duty set in the mask area PY2 corresponding to the second pass is 40% in a second half and 30% in a first half; the print duty set in the mask area PY3 corresponding to the third pass is 30% in a second half and 20% in a first half; and the print duty set in the mask area PY4 corresponding to the fourth pass is 20% in a second half and 10% in a first half.

In this embodiment, by using the mask pattern described above, the print areas on the print medium (first pass print area to fourth pass print area) to be printed by the first to fourth nozzle groups are printed with differing print duties, and each print area is not printed with a uniform print duty but is divided in two in the print medium feed direction, with the two divided areas printed with differing print duties.

Further, the mask patterns PC, PM, PY for the print heads C, M, Y, which are differentiated from each other as described above, have a complementary relation with one another in order to eliminate color variations caused by a change in the printing order of the print heads during the bi-directional printing.

That is, the mask patterns PC, PM, PY are so formed that the scan performed with the maximum print duty among the four printing scans changes from one mask pattern to another. More specifically, in the C mask pattern, the print duty is maximum (at 40%) in the third and fourth pass (first half of the mask area PC3 and second half of the mask area PC4); in the M mask pattern, the print duty is maximum (at 40%) in the second and third pass (first half of the mask area PM2 and second half of the mask area PM3); and in the Y mask pattern, the print duty is maximum (at 40%) in the first and second pass (first half of the mask area PY1 and second half of the mask area PY2).

Therefore, the color whose print duty becomes high varies from one pass to another. Consider a case, for example, in which a green solid image is formed by overlapping cyan and yellow. In the first and second passes, cyan is printed with a print duty of 40% ((50+30)/2%) while yellow is printed with a print duty of 60% ((50+70)/2%). Hence, in the first half of the four passes, i.e., in the first and second passes, yellow is printed more heavily by 20% of print duty. This yellow ink that is printed excessively constitutes at least a primary color of yellow that is not overlapped with cyan. That is, the yellow ink that is printed in the first two forward and backward scans is printed 20% more heavily than cyan prior to the latter two forward and backward scans, regardless of its printing order. In this way, because a particular color ink can be printed first irrespective of its printing order in the bi-directional printing, it is possible to reduce the color variation caused by a difference in the printing order among different print areas.

Further, in this embodiment, since each of the nozzle groups in each print head is divided into two subdivided parts and the print duties of the subdivided parts of each nozzle group are set individually, the print areas that are printed with high print duties are also divided into smaller areas, making it possible to control the print duty for each color ink in more finely divided areas.

Figure 16:
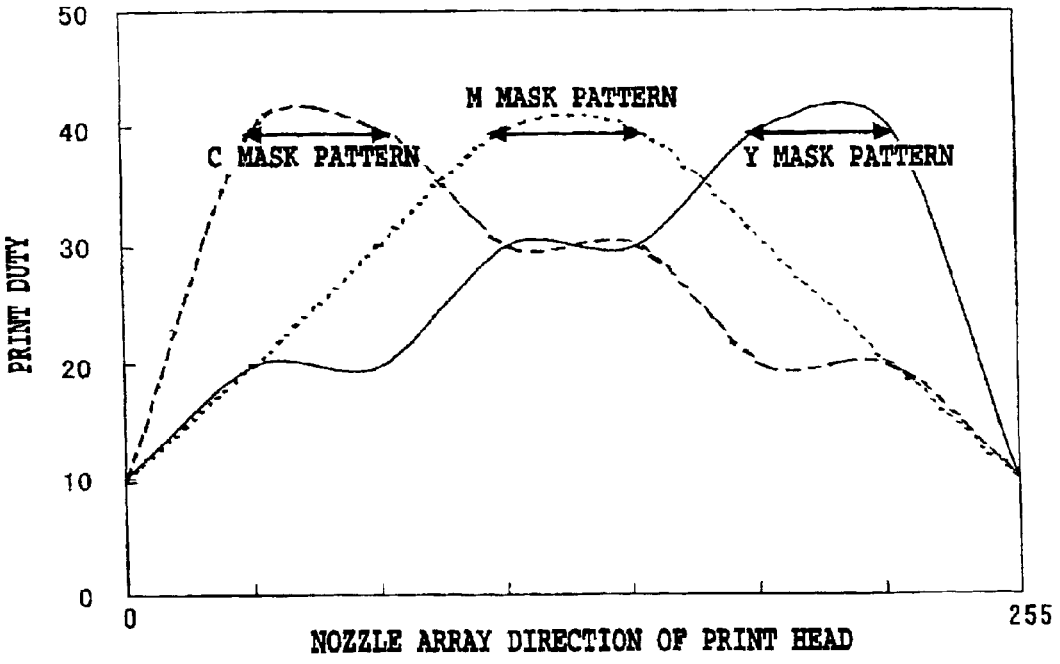
FIG. 16 is an explanatory view showing the print duties of the print heads of FIG. 15 as they are smoothly changed.

In the embodiment above, the print duty is set for each subdivided part of each nozzle group so that it changes stepwise as shown in FIG. 15. It is also possible to set the print duty to change smoothly as indicated by a smooth curve of FIG. 16. FIG. 16 is a line diagram showing the print duties of the print heads C, M, Y. with an abscissa representing the direction of nozzle array and an ordinate representing the print duty in each area. Also when the print duty is changed smoothly as shown in the figure, it is still possible, as when the print duty is set stepwise as shown in FIG. 15, to distinguish between a color with a high frequency of nozzle use and a color with a low frequency of nozzle use. Setting the print duty distribution in the divided areas of the mask patterns PC, PM, PY to follow smooth curves in this way can be realized by further increasing the number of divisions in each mask area of each mask pattern PC, PM, PY. This setting can produce the color variation reduction effect similar to the one obtained by the duty setting method shown in FIG. 15 and thus can reduce texture of an image. Although in the first embodiment shown in FIG. 15 and FIG. 16 the peak (maximum) value of the print duty in each mask pattern PC, PM, PY is set at one location, it is also possible to set the duty ratio in each mask pattern to have a plurality of maximum and minimum values. In this case, too, the print duties need to be set so as to maintain their complementary relationship in each print head and to differentiate the phases of the maximums and minimums among the print heads.

Figure 17A:
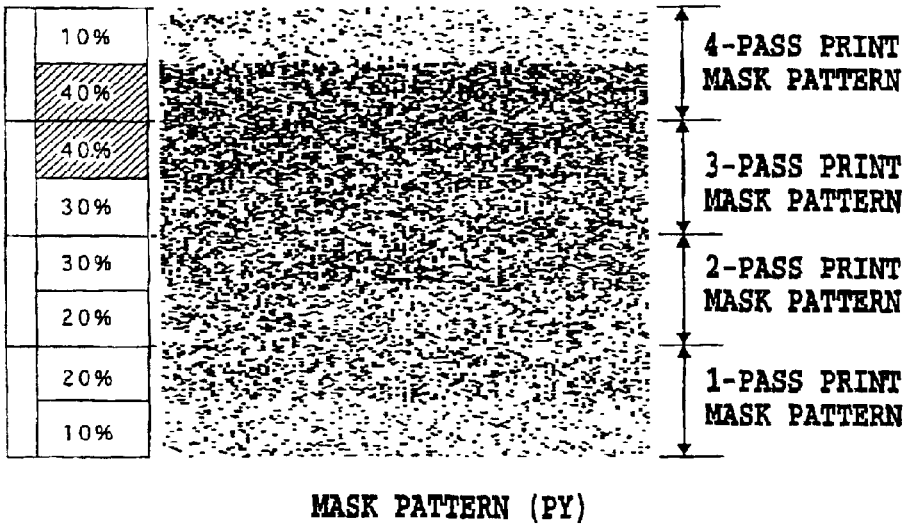
FIGS. 17A to 17C are explanatory views showing example mask patterns of FIG. 15.
Figure 17B:
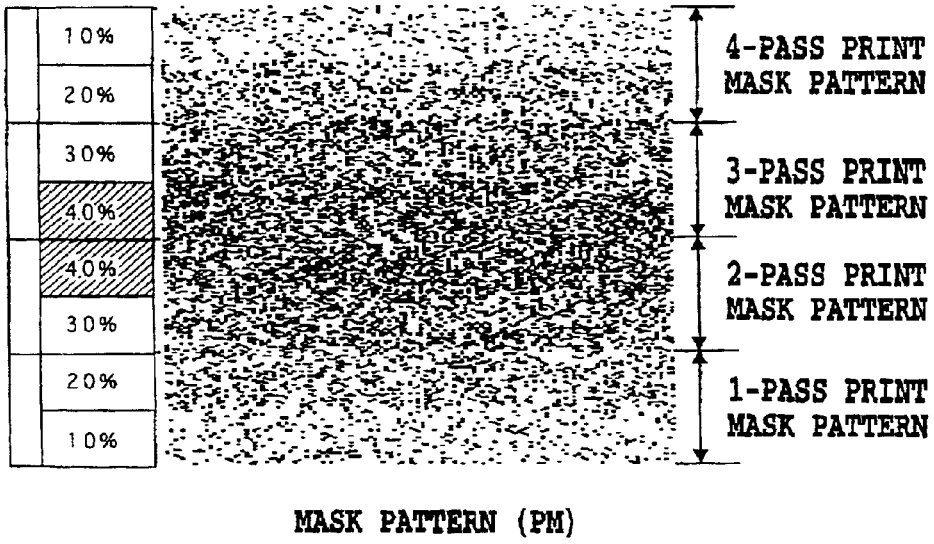
Figure 17C:
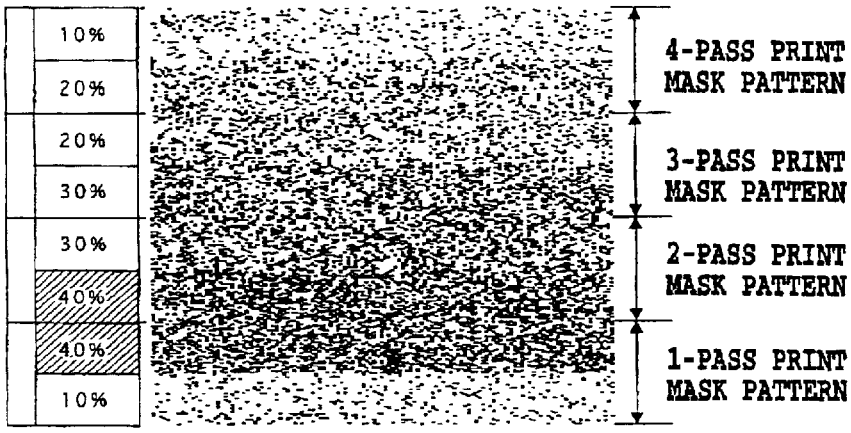

FIGS. 17A to 17C show example mask patterns based on the duty settings of FIG. 16.

These mask patterns each have a size of 256 dots×256 dots, with dot concentrations each measuring 2 dots×1 dot arranged at random. It is seen from the figure that each of the color mask patterns has a deviation in the print duty distribution of each print head, the print duty being set in each mask area.

Figure 18:
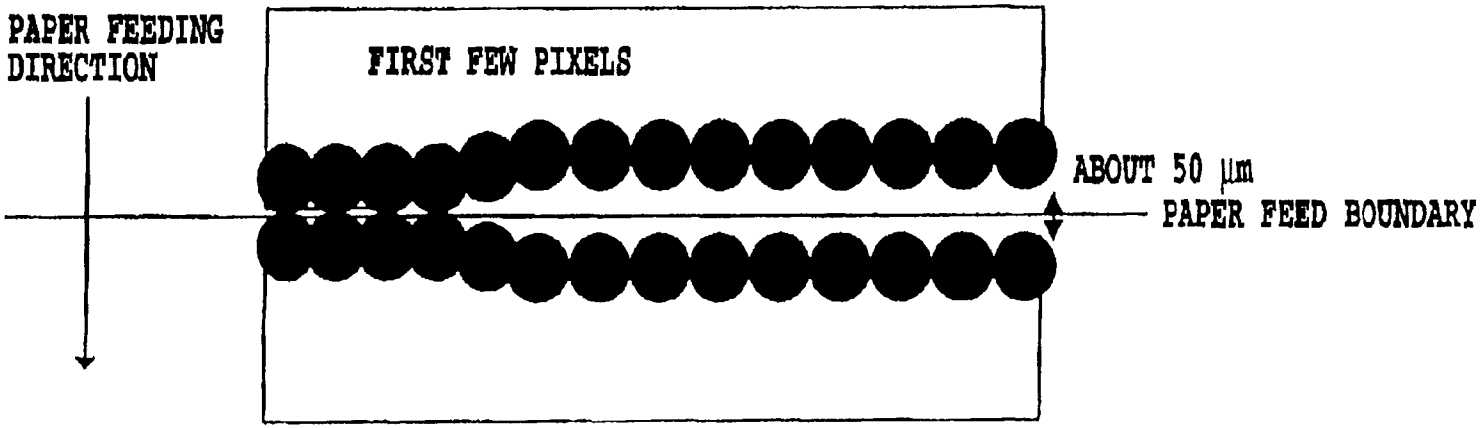
FIG. 18 is an explanatory view, seen from above, of an ink dot shifting phenomenon observed at ends of the print heads.
Figure 19:
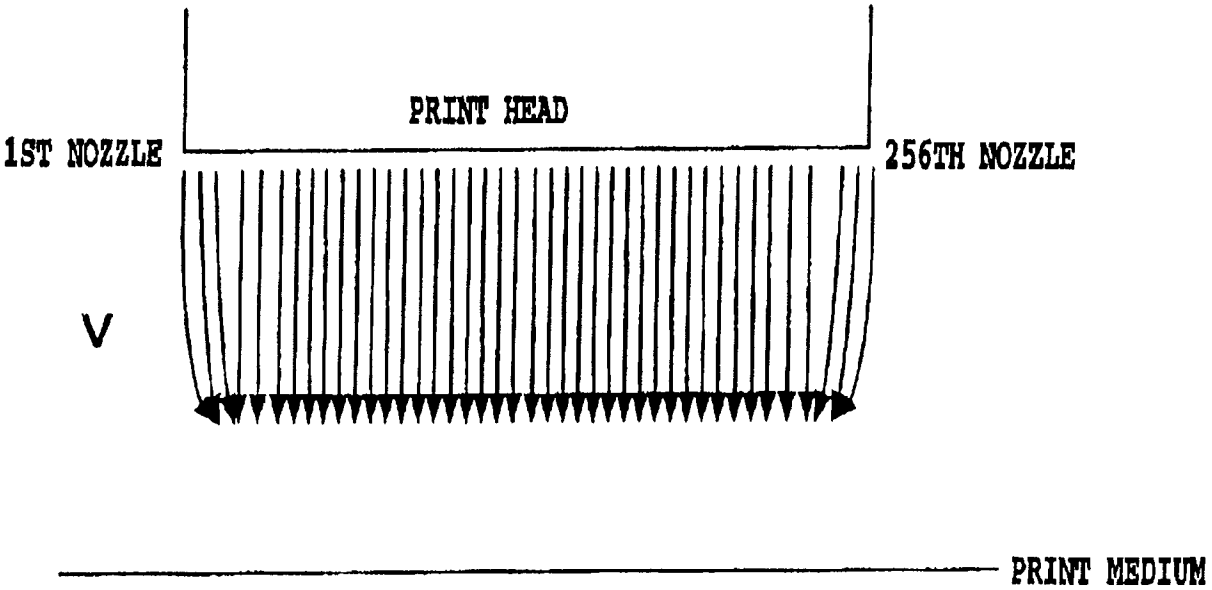
FIG. 19 is an explanatory view, seen from front, of an ink dot shifting phenomenon observed at ends of the print heads.

This embodiment enables a high density printing by using a print head with a pitch of 1200 dpi and an ejection volume of 4 pl. With a print head having such a small pitch and a small ejection volume, the droplets ejected from nozzles at the ends of the print head are shifted inwardly (deviation phenomenon) after the printing operation has started, as shown in FIG. 18 and FIG. 19. This deviation is not observed in the first few dots after the start of the printing but, as the carriage is accelerated, begins to increase until the dot landing position is deviated about 50 $\mu$m and remains there.

This dot landing deviation is likely to produce a blank line at a boundary portion between printing areas on the print medium where no ink dots are formed, significantly degrading the image quality.

To prevent such a blank line from being formed, this embodiment sets to a small value the print duties of those nozzles at the ends of the print head whose dots may be deviated inwardly, thereby reducing the frequency of use of the nozzles at the ends of the head. Since with this method the number of deviated dots is reduced, the influence of dot deviations can be alleviated significantly, thus preventing the formation of blank lines on a printed image and improving the image quality.

While in the embodiment above we have described a case where the print duty setting area for each nozzle group of the print head is divided in two, it is possible to divide the print duty setting area for each nozzle group into more than two areas.

Figures 20A, 20B:
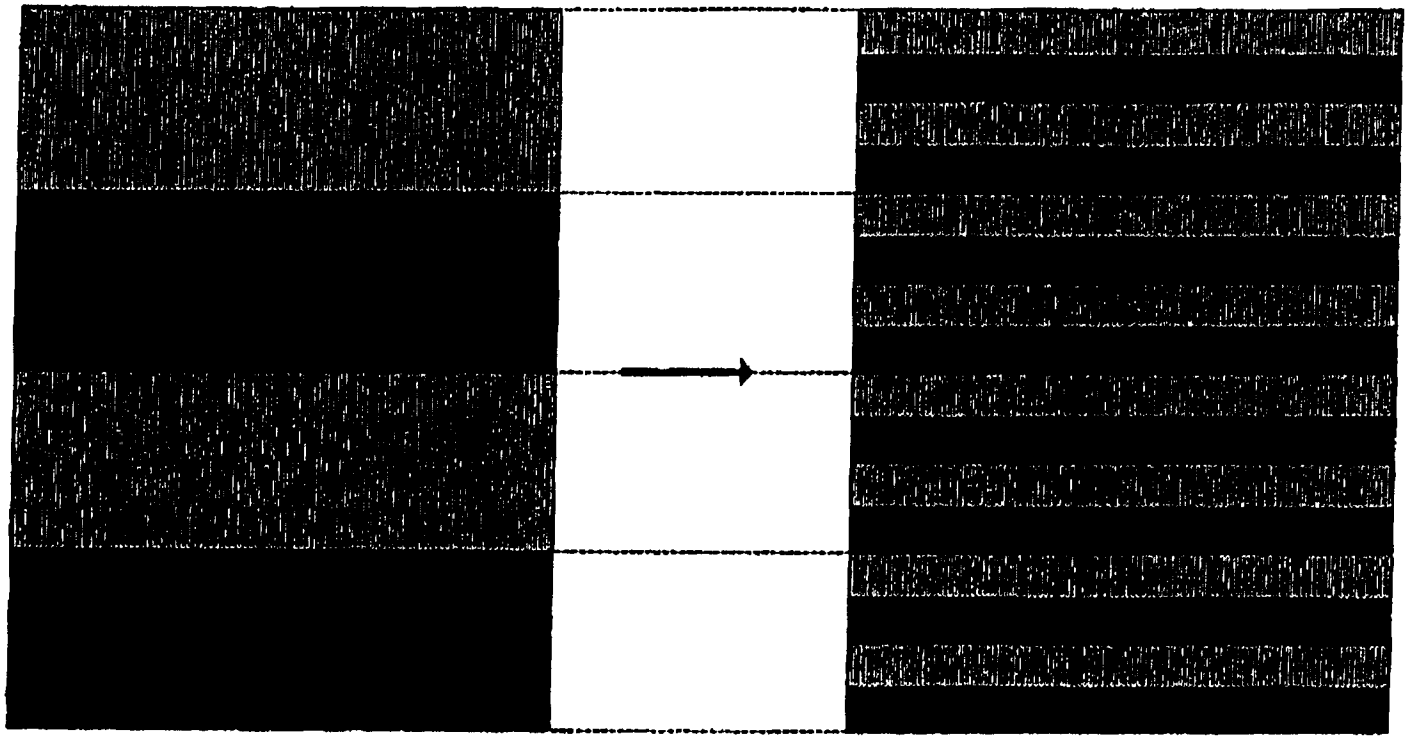
FIG. 20A is an explanatory view showing setting areas of print duties for associated nozzle groups in the print heads of the invention when the number of divisions in each nozzle group is 1.
FIG. 20B is an explanatory view showing setting areas of print duties for associated nozzle groups in the print heads of the invention when the number of divisions in each nozzle group is 4.

In a 4-pass bi-directional printing for example, the print duty of each nozzle group for one pass may be divided into four print duties, as shown in FIG. 20B.

FIG. 20A represents a case where each nozzle group is set to a uniform print duty (the number of divisions of the duty setting area is set to 1). FIG. 20B represents a case where the print duty setting area for each nozzle group is divided into four. In the four subdivided setting areas, the hue varies according to a difference in the ink ejection order between the forward pass and the backward pass and to how the print duties of the subdivided areas for each nozzle group are arranged.

When a uniform solid pattern is printed by dividing the print duty setting area in two, as shown in the embodiment of FIG. 15, the image quality is improved substantially when compared with an image printed with a uniform print duty distribution shown in FIG. 20A. The image thus printed, however, may have a possibility of slight density variations being observed. This is because the width of each subdivided area equal to one-half the width of each nozzle group of the print head falls within a range that can be recognized by the human vision. Studies conducted by this inventor have verified that only when the print duty setting area is divided at a pitch smaller than 60 μm, does the effect of reducing the color variations (banding) caused by an ejection order difference become significant. Examinations were made on the color variation reduction effect for various division numbers by progressively increasing the number of divisions at pitches smaller than 60 μm. It was confirmed that once the pitch decreased to 60 μm or less, no significant improvement in the image quality was observed even when the number of divisions was increased further.

A further examination was conducted as to the number of divisions of the print duty setting area for each nozzle group. When a 4-pass printing is done using a head construction of FIG. 14 (1200 dpi and 256 nozzles), it is confirmed that the color variation reduction effect is obtained when the setting area is divided into eight subdivided areas.

It should be noted that the present invention is not limited to the embodiment described above and that the number of multiple passes used in the applied printing system and the number of subdivided print duty setting areas for each nozzle group can be set to optimum values according to the print media used.

(Second Embodiment)

Next, a second embodiment of the present invention will be described.

In the mask patterns PC, PM, PY of the print heads in the first embodiment, the print duties set for the associated nozzle groups of each print head are made to vary, as shown in FIG. 15 or FIG. 16. Hence, a nozzle group set with a high print duty has a higher frequency of use than those of other nozzle groups at all times and thus may be degraded more significantly than other nozzle groups. To deal with this problem, the second embodiment, in addition to using the similar mask pattern to that used in the first embodiment, comprises a dot count means or timer means and a pattern reversing means for reversing the print duty distribution in the mask pattern according to a count value or measured time produced by the dot count means or timer means. The reversion referred to in this specification means a switching between a part of the print duty distribution with a relatively high print duty and a part with a relatively low print duty. The levels of high print duty and low print duty can be set arbitrarily and the reversion includes a switching in which the high level and the low level of print duty do not necessarily have a one-to-one correspondence. In other words, the reversion includes a case where the high level and the low level are not strictly symmetrical with respect to a predetermined reference value.

Figure 21:
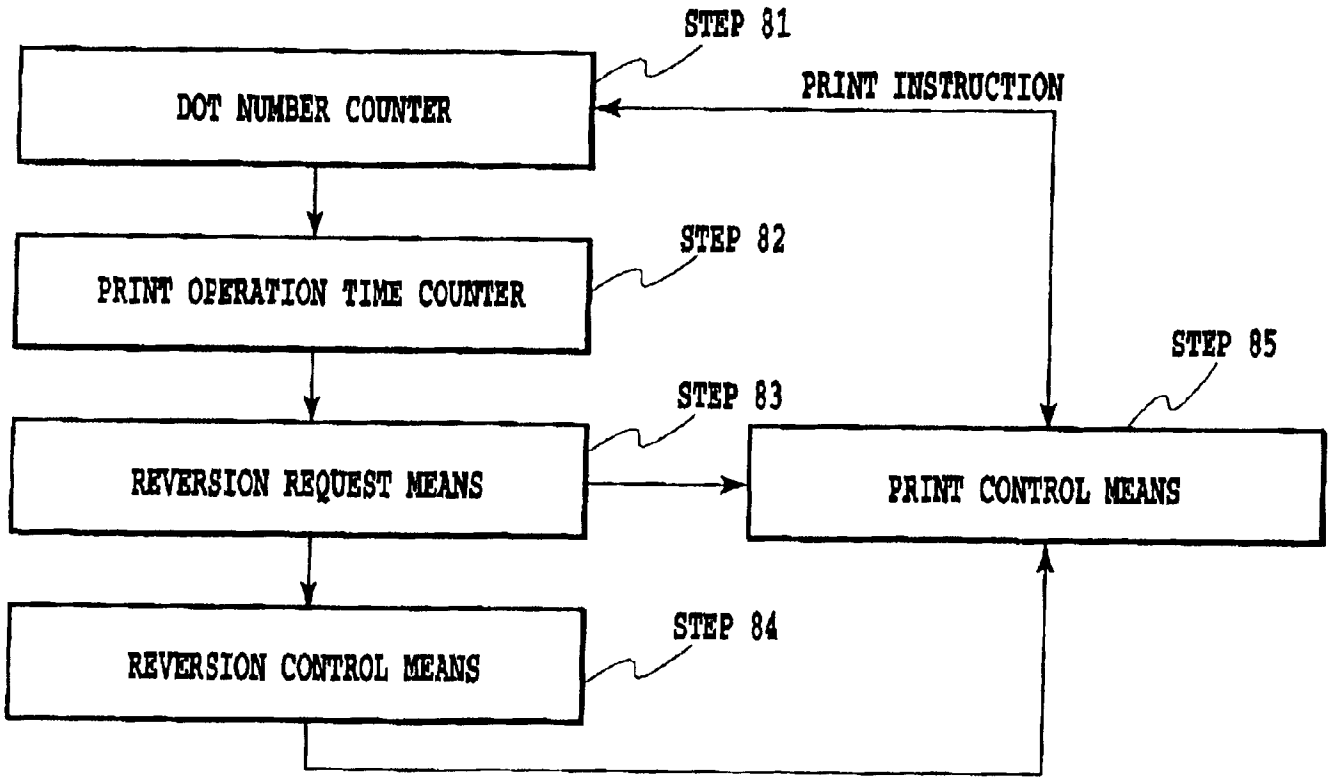
FIG. 21 is a block diagram showing a configuration of a control system of a second embodiment of the invention.

FIG. 21 is a block diagram showing an outline configuration of a control system that performs a control operation in the second embodiment of the invention.

In FIG. 21, reference number 85 designates a print control means; 81 a printed dot number counter for counting the number of dots printed from the start of the printing operation of the print head up to now; 82 a print time counter for counting the time it takes from when the print duties of the mask pattern were previously reversed or when the print operation was started by turning power on until the present time; 83 a reversion request means for requesting a reversion of the print duty distribution in the print head; and 84 a reversion control means for reversing the print duty distribution in the print head according to the request from the reversion request means.

The print operation control means 85, upon receiving a print instruction, controls the operation of the print heads, carriage and control medium feed means to form an image on the print medium according to print data. The reversion request means 83 determines a timing to reverse the mask pattern duties based on a comparison between the current printed dot number count value and a preset dot number and a comparison between a print time count value and a preset print time.

Figure 22:
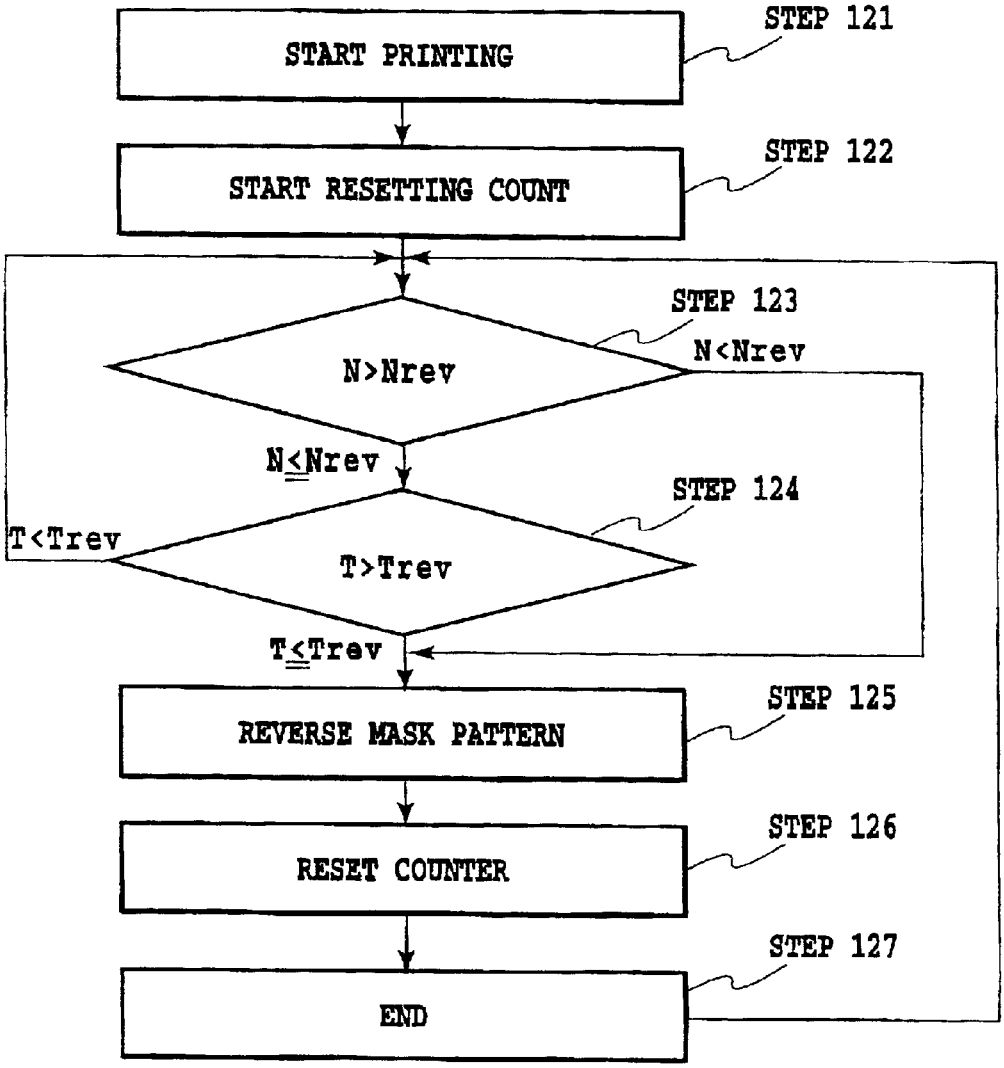
FIG. 22 is a flow chart showing a control of a mask pattern print duty reversing operation in the second embodiment of the invention.

Next, the operations of various parts will be explained by referring to a flow chart of FIG. 22. In FIG. 22, when the print operation control means 85 receives a print instruction and starts the print operation by driving the print heads, carriage and print medium feed means (step 121), a printed dot number counter 81 and a print time counter 82 start counting the printed dot number and the print time (step 122).

During the print operation, the reversion request means 83 is comparing the printed dot number N counted from the start of the print head operation up to now with the preset dot number Nrev at all times (step 123). If N>Nrev, the reversion request means 83 sends an instruction for reversing the print duties of the mask patterns to the print operation control means 85 and the reversion control means 84 to reverse the print duties of the mask patterns (step 125). In this embodiment, two mask patterns with reversed thinning out duties (print duties) are stored in a ROM in the printing apparatus for each color. In response to the reversion request, one of the two mask patterns that is currently used is switched to the other for reversing the print duties.

Further, a comparison is made between the print time T, which has elapsed from the start of the print head operation or from the previous mask pattern reversing operation up to now, and the preset print time Trev (step 124). If T>Trev, the instruction for reversing the print duties set by the mask pattern is sent to the print operation control means 85 and the reversion control means 84 to execute the print duty reversion operation (step 125). Because performing this reversion during the print operation may cause image impairments, the reversion operation is preferably performed at a timing that do not adversely affect the print operation, for example after the print medium is discharged.

After the mask pattern print duty reversion operation has been executed, the printed dot number counter 81 and the print time counter 82 both reset their count values (step 126) and restart their counting operations. In step 123 and step 124, if N Nrev and T Trev, the reversion of the print duties set by the mask patterns is not performed.

Figure 23:
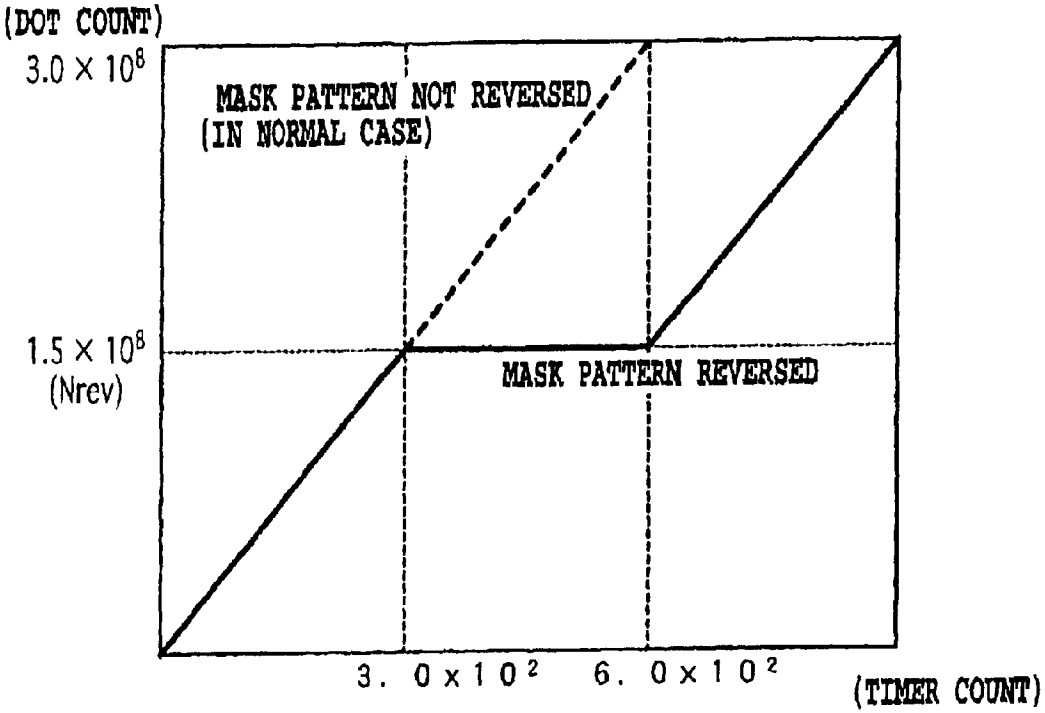
FIG. 23 is a line diagram showing an example setting of timing at which to execute the print duty reversing operation.

FIG. 23 shows an example setting of the timing at which to perform the print duty reversing operation. In the figure, an abscissa represents T (print time count value) and an ordinate represents N (dot number count value).

In the figure the print head is assumed to have an ejection life of $3\times10^8$ dots. Let us consider one nozzle group in the print head. In this case, the print duty of the nozzle group is set at a high value by the mask pattern until the number N of dots ejected from the print head reaches $1.5\times10^8$ dots (Nrev) which is one-half the ejection life dot number, or until the time from the start of the print head operation reaches $3.0\times10^2$ days (Trev) (in FIG. 23 both figures coincide at one point). That is, until one of these values is reached, the frequency of use of the nozzle group is set high.

When the dot number N exceeds $1.5\times10^8$ dots (Nrev) or when the time passes a preset time of $3.0\times10^2$ days (Trev), the print duty set by the mask pattern are reversed (first reversion) to a low value. That is, the frequency of use of the nozzles decreases. The mask pattern that sets the reduced print duty continues to be used until the printed dot number N or the time following the first reversion reaches $1.5\times10^8$ dots (Nrev) or $3.0\times10^2$ days (Trev).

Following this first reversion, when $1.5\times10^8$ dots are printed or $3.0\times10^2$ days pass (in FIG. 23, $6.0\times10^2$ days after the start of the print operation), the print duty is reversed again (second reversion). As a result, the print duty of this nozzle group becomes high and the frequency of use of the nozzles increases.

As described above, in this embodiment, when the preset value of either the print operation time count or the dot count is exceeded, the reversing operation is performed repetitively. With this arrangement, the nozzle groups in the print head can be used at a uniform frequency, thus preventing only a part of the nozzles from deteriorating significantly and from reducing the life of the print head as a whole.

The preset dot number Nrev and the preset print operation time Trev are set at such values that the life of the print head is longer by about 1.5 times than when the print duty reversion is not performed. The set values of the print operation time count and the dot number count can be set arbitrary.

In a color printing that is performed using a plurality of print heads with different ink ejection conditions (e.g., preset print operation time Trev, preset dot number Nrev, etc.), when any one of the print heads reaches a state where it is required to reverse the print duties of the associated mask pattern, it is desired that the print duties of all the print heads be reversed at one time.

Figure 24A:
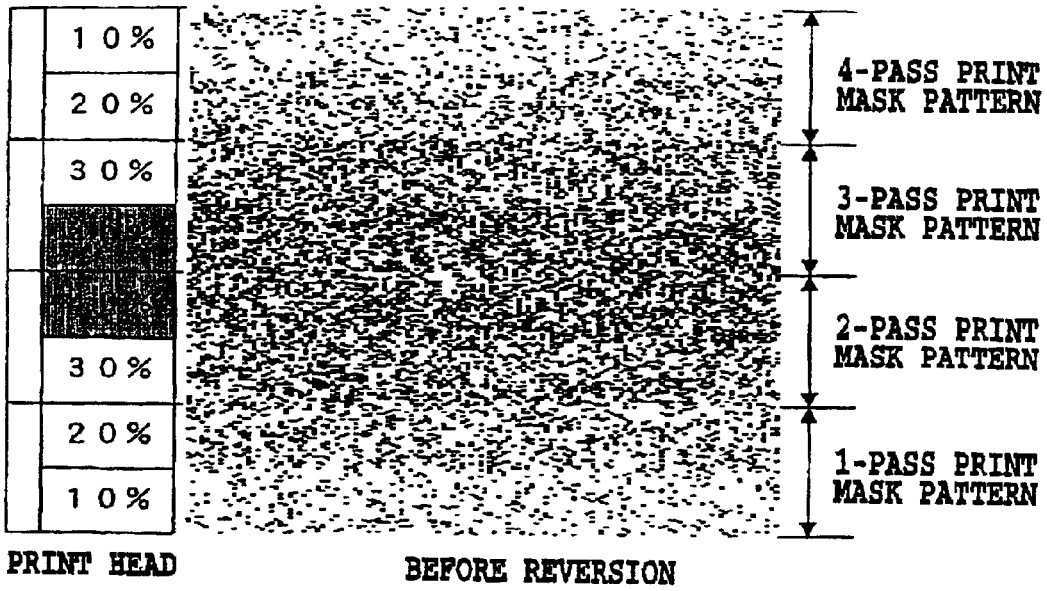
FIG. 24A illustrates an example mask pattern, before being reversed, used in the second embodiment of the invention.
Figure 24B:
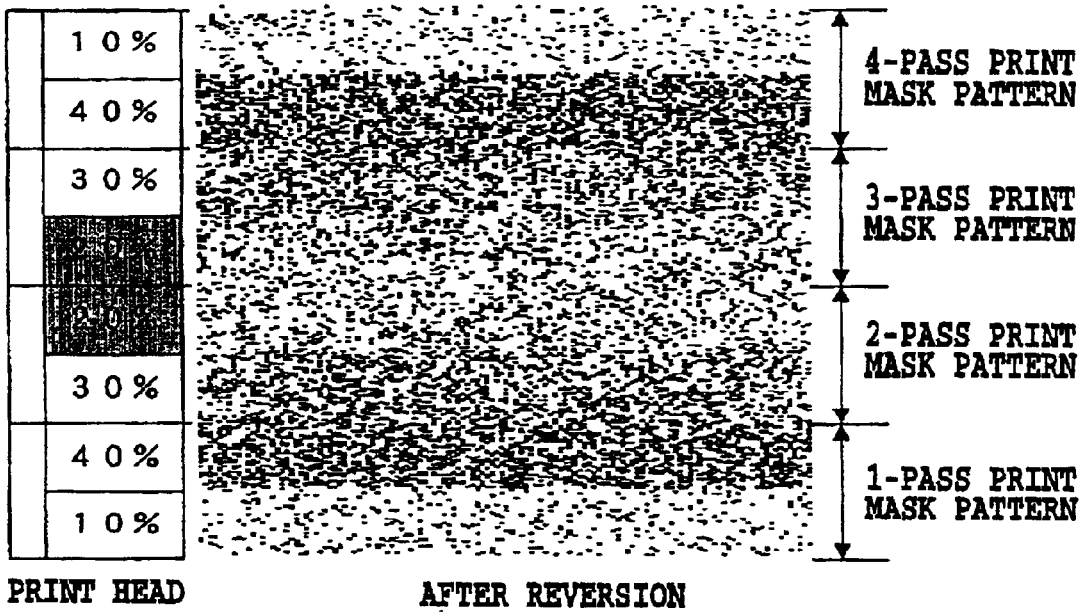
FIG. 24B illustrates an example mask pattern, after being reversed, used in the second embodiment of the invention.

FIG. 24A and FIG. 24B show a mask pattern before being reversed and a mask pattern after being reversed. When the mask pattern of FIG. 24A is reversed to that of FIG. 24B, the print duty in each scan changes as follows.

That is, in the first scan the print duty changes from 15% (=(20+10)/2%) to 25% (=(10+40)/2%); in the second scan it changes from 35% (=(30+40)/2%) to 25% (=(30+20)/2%); in the third scan it changes from 35% (=(40+30)/2%) to 25% (=(40+10)/2%); and in the fourth scan it changes from 15% (=(20+10)/2%) to 25% (=(40+10)/2%). By switching between the two mask patterns in this way, it is possible to change the print duty of the nozzles that are set with a low print duty to a high print duty and the print duty of the nozzles that are set with a high print duty to a low print duty, thus rendering the frequency of use of the nozzles more uniform.

In the print duty distribution shown in FIGS. 24A and 24B, too, the print duties of the end portions are set low as in the first embodiment to cope with the end dot deviation phenomenon. Therefore, in areas excluding these end portions, the mask pattern is generated so that its print duty is 30% in average. That is, because the second pass and the third pass have a print duty of 35% before the reversion and 25% after the reversion, their average is 30%.

In the second embodiment above, we have described an example case where the preset values of the dot number count and the print operation time count are used as threshold values to determine whether or not the reversion operation should be performed. It is also possible to adopt an arrangement in which the number of print mediums printed is taken as a threshold for determining whether or not to execute the reversion operation and in which when the number of printed mediums reaches a predetermined number, the mask pattern is changed.

(Other Embodiments)

In the embodiments above, we have shown example arrangements that eliminate color variations caused by a difference in the printing order between the forward pass and the backward pass and those caused by deviations of ink dots ejected from the ends of the print head. When a secondary or higher order color is formed, these color variations may or may not be conspicuously visible depending on the combination of colors.

Figure 26A:
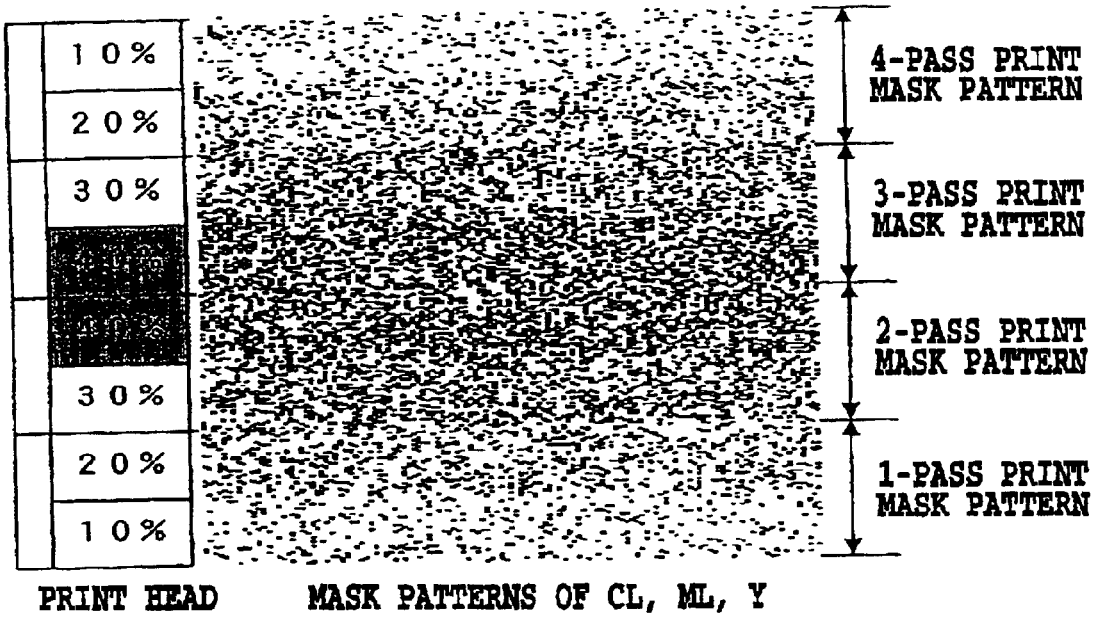
FIG. 26A is an explanatory view showing a mask pattern for use with dark inks in a further embodiment of the invention.
Figure 26B:
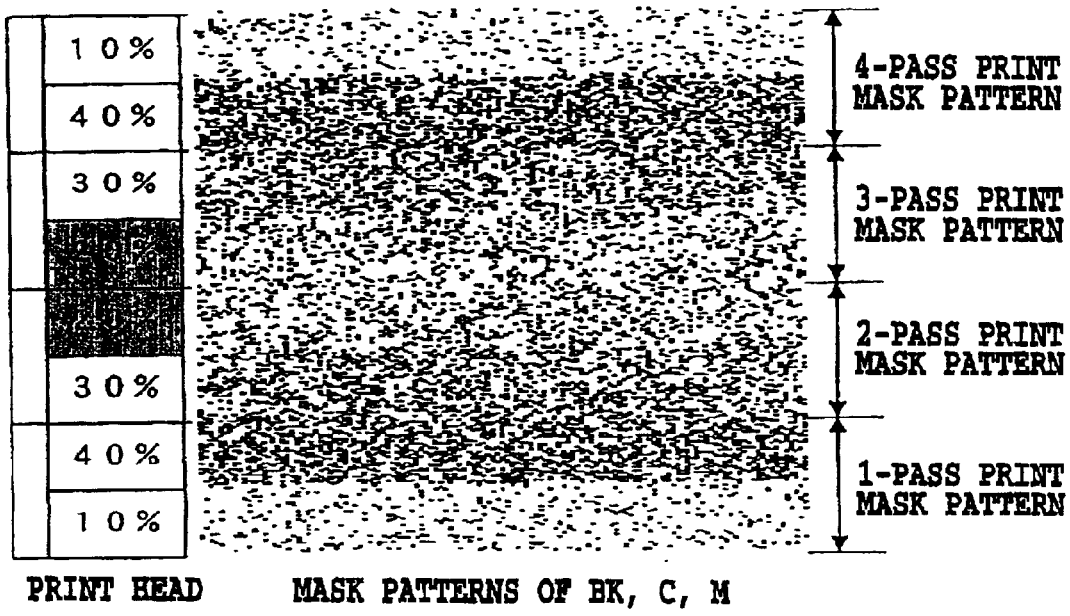
FIG. 26B is an explanatory view showing a mask pattern for use with light inks in the further embodiment of the invention.

For example, when a secondary color solid image is formed using six color inks (Bk, CL, ML, C, M, Y inks), the investigation by this inventor has found that conspicuous color variations are observed when a group of light inks (CL, ML, Y) and a group of dark inks (Bk, C, M) are combined (see FIG. 25). Therefore, a mask pattern for light inks (CL, ML, Y) and a mask pattern for dark inks (Bk, C, M) are prepared as shown in FIGS. 26A and 26B, with their print duty distributions reversed in the direction of nozzle array. Combining these mask patterns can reduce the color variations.

The mask pattern combination described above can also be applied to a combination of colors with different ejection volumes, in addition to the combination of dark inks and light inks. That is, two kinds of mask patterns can be used, one for a group of colors with large ejection volumes and one for a group of colors with small ejection volumes.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink jet printing apparatus comprising:

a plurality of print heads arranged in a main scan direction and having different inks, each of the print heads having a plurality of nozzle groups, each nozzle group having a plurality of ink ejection nozzles, the different nozzle groups in each of the print heads being scanned over the same print area on a print medium in forward and backward passes to complete an image on the print area by using a plurality of inks; and a print duty setting means for setting a print duty, in which each of the nozzle groups of the plurality of print heads are divided into a plurality of nozzle areas, each nozzle area including a series of a plurality of nozzles, and a print duty is set in one scan for each of the divided nozzle areas, the print duty being a comparative rate between a print amount printable onto the print area to be printed by one scan and a print amount to be actually printed on the print area;

wherein said print duty setting means renders the print duty corresponding to one nozzle area of a predetermined print head different from a print duty corresponding to a nozzle area of at least one of the other print heads.

2. An ink jet printing apparatus according to claim 1, wherein the print duty setting means sets a print duty of a predetermined nozzle group in at least one of the print heads to a value different from a print duty of a corresponding nozzle group in another print head.

3. An ink jet printing apparatus according to claim 1, wherein when two or more inks are combined to form an image, the print duty setting means sets a print duty according to densities of the inks to be combined.

4. An ink jet printing apparatus according to claim 1, wherein when two or more inks are combined to form an image, the print duty setting means sets a print duty according to ejection volumes of the inks to be combined.

5. An ink jet printing apparatus according to claim 1, wherein the print duty setting means differentiates among different inks phases of maximum values in a print duty distribution in a nozzle array direction.

6. An ink jet printing apparatus according to claim 1, wherein when two or more inks are combined to form an image, maximum values in a print duty distribution in a nozzle array direction are set according to densities of the ink to be combined.

7. An ink jet printing apparatus according to claim 1, wherein said print duty setting means sets print duties of end portions of each of the print heads lower than print duties of other portions.

8. An ink jet printing apparatus comprising:

a plurality of print heads arranged in a main scan direction and having different inks, each of the print heads having a plurality of nozzle groups, each nozzle group having a plurality of ink ejection nozzles, the different nozzle groups in each of the print heads being scanned over the same print area on a print medium in forward and backward passes to complete an image on the print area by using a plurality of inks; and a print duty setting and modification means for switching a print duty distribution in a nozzle array direction between high and low values according to a frequency of use of the print head.

9. An ink jet printing apparatus according to claim 8, wherein the print duty setting and modification means switches the print duty distribution in at least one of two cases where a print operation time from the start of a print head operation up to now exceeds a preset time and where a printed dot number from the start of a print head operation up to now exceeds a preset printed dot number.

10. An ink jet printing apparatus according to claim 9, wherein the print duty setting and modification means comprises:

a first mask pattern for setting a predetermined print duty for each print head;

a second mask pattern for setting a print duty with a distribution different from that of the first mask pattern; and a switching means for switching between the first mask pattern and the second mask pattern a mask pattern to be used when at first one of two cases occurs in which a print operation time from the start of a print head operation up to now exceeds a preset time and in which a printed dot number from the start of a print head operation up to now exceeds a preset printed dot number.

11. An ink jet printing apparatus according to claim 8, wherein when two or more inks are combined to form an image, the print duty setting and modification means sets a print duty according to densities of the inks to be combined.

12. An ink jet printing apparatus according to claim 8, wherein when two or more inks are combined to form an image, the print duty setting and modification means sets a print duty according to ejection volumes of the inks to be combined.

13. An ink jet printing apparatus according to claim 8, wherein the print duty setting and modification means reverses print duties of each of the print heads excluding head end portions.

14. An ink jet printing method for an ink jet printing apparatus, wherein the ink jet printing apparatus includes a plurality of print heads arranged in a main scan direction and having different inks, each of the print heads having a plurality of nozzle groups, each nozzle group having a plurality of ink ejection nozzles, the ink jet printing method comprising the steps of:

scanning the different nozzle groups in each of the print heads over the same print area on a print medium in forward and backward passes to complete an image on the print area by using a plurality of inks;

setting a print duty, in which each of the nozzle groups of the plurality of print heads are divided into a plurality of nozzle areas, each nozzle area including a series of a plurality of nozzles, and a print duty is set in one scan for each of the divided nozzle areas, the print duty being a comparative rate between a print amount printable onto the print area to be printed by one scan and a print amount to be actually printed on the print area;

wherein said print duty setting step includes rendering the print duty corresponding to one nozzle area of a predetermined print heed different from a print duty corresponding to a nozzle area of at least one of the other print heads.

15. An ink jet printing method according to claim 14, wherein said print duty setting step includes setting print duties of end portions of each of the print heads lower than print duties of other portions.

16. An ink jet printing method for an ink jet printing apparatus, wherein the ink jet printing apparatus includes a plurality of print heads arranged in a main scan direction and having different inks, each of the print heads having a plurality of nozzle groups, each nozzle group having a plurality of ink ejection nozzles, the ink jet printing method comprising the steps of:

scanning the different nozzle groups in each of the print heads over the same print area on a print medium in forward and backward passes to complete an image on the print area by using a plurality of inks; and switching a print duty distribution in a nozzle array direction between high and low values according to a frequency of use of the print head.

17. An ink jet printing apparatus having a plurality of print heads, the plurality of print heads including a plurality of nozzles arranged thereon for a plurality of colors, wherein scanning means scans the plurality of print heads across a printing medium to perform printing, the apparatus comprising:

print controlling means for performing a plurality of scans along the same print area on the print medium by the plurality of print heads, in each of the plurality of scans, a position printable with one scan by one nozzle being printed by another nozzle of the print heads;

thinning out means for thinning out print data corresponding to a print area printable by one scan of the print heads by using a mask pattern corresponding to each of the plurality of print heads, wherein the mask pattern is a pattern according to a thinning out rate which corresponds to each of a plurality of nozzle areas, each nozzle area being a consequence of dividing a plurality of nozzles to be arranged on each print head, and wherein there is a difference in thinning out rate corresponding to the same printing position between a mask pattern corresponding to a predetermined print head and a mask pattern corresponding to at least one different print head.

18. An ink jet printing apparatus as claimed in claim 17, wherein the mask pattern makes a thinning out rate of the printing area corresponding to the plurality of nozzles to be arranged at the ends of the print heads to have a thinning out rate higher than that of the printing area corresponding to the plurality of nozzles to be arranged on portions other than the ends.

19. An ink jet printing apparatus as claimed in claim 17, wherein the nozzle areas each include a plurality of nozzles in series.

* * * * *

UNITED STATES PATENT AND TRADEMARK OFFICE

CERTIFICATE OF CORRECTION

PATENT NO. : 6,779,873 B2
DATED : August 24, 2004
INVENTOR(S) : Tetsuhiro Maeda et al.

It is certified that error appears in the above-identified patent and that said Letters Patent is hereby corrected as shown below:

Column 1,
Line 35, “optimumly” should read -- optimally --.

Column 2,
Line 44, “image” should read -- images --; and
Line 67, “elongate” should read -- elongated --.

Column 3,
Line 18, “50 $\mu$m” should read -- 50 $\mu$m. --.

Column 4,
Lines 21 and 48, “In” should read -- In a --;

Column 6,
Line 63, “to” should read -- to as --.

Column 7,
Line 29, “rotated forwardly” should read -- forwardly rotated --; and
Line 52, “as” should be deleted.

Column 12,
Line 13, “clock” should read -- clocks --; and
Line 21, “most” should be deleted.

Column 14,
Line 27, “these” should read -- this --.

Column 18,
Line 24, “shifted inwardly” should read -- inwardly shifted --; and
Line 38, “deviated inwardly,” should read -- inwardly deviated, --.

Column 20,
Line 38, “do” should read -- does --;
Line 59, “set” should read -- set to --; and
Line 62, “are” should read -- is --.

Column 21,
Line 19, “arbitrary” should read -- arbitrarily --.

UNITED STATES PATENT AND TRADEMARK OFFICE

CERTIFICATE OF CORRECTION

PATENT NO. : 6,779,873 B2
DATED : August 24, 2004
INVENTOR(S) : Tetsuhiro Maeda et al.

It is certified that error appears in the above-identified patent and that said Letters Patent is hereby corrected as shown below:

Column 22,
Line 44, “area;” should read -- area, --.

Column 23,
Line 38, “at first” should read -- at least --.

Column 24,
Line 8, “area;” should read -- area, --; and
Line 11, “heed” should read -- head --.

Signed and Sealed this

Fourteenth Day of December, 2004

JON W. DUDAS
*Director of the United States Patent and Trademark Office*